US005931221A

United States Patent [19]

Inoue et al.

[11] Patent Number: 5,931,221

[45] Date of Patent: Aug. 3, 1999

[54] HEAT EXCHANGER

[75] Inventors: Seiji Inoue; Kunihiko Nishishita, both of Konan; Fumio Ohkubo, Higashimatsuyama, all of Japan

[73] Assignee: Zexel Corporation, Tokyo, Japan

[21] Appl. No.: 09/024,582

[22] Filed: Feb. 18, 1998

[30] Foreign Application Priority Data

Feb. 21, 1997 [JP] Japan ..... 9-053847
Mar. 31, 1997 [JP] Japan ..... 9-098250

[51] Int. Cl.[6] ..... F28D 1/03; F28F 7/00

[52] U.S. Cl. ..... 165/69; 165/153; 165/176

[58] Field of Search ..... 165/153, 176, 165/69

[56] References Cited

U.S. PATENT DOCUMENTS 4,800,954 1/1989 Noguchi et al. ..... 165/153
5,046,554 9/1991 Iwasaki et al. ..... 165/44 X
5,511,611 4/1996 Nishishita ..... 165/153
5,632,328 5/1997 Sawyer et al. ..... 165/69

FOREIGN PATENT DOCUMENTS 244282 9/1989 Japan ..... 165/176
371798 12/1992 Japan ..... 165/153
118705 5/1993 Japan ..... 165/153

*Primary Examiner*—Leonard Leo
*Attorney, Agent, or Firm*—Wenderoth, Lind & Ponack, L.L.P.

[57] ABSTRACT

In order to achieve an improvement in the recyclability of a heat exchanger by mounting a seal material for sealing the gap between the heat exchanger and the case in which the heat exchanger is mounted without using an adhesive or the like at the heat exchanger and thus facilitating the removal of the seal material, an arrangement for mounting the seal material is provided at a specific position at an external circumferential portion of the heat exchanger. For instance, a guide is provided by inwardly bending the central portion in the direction of airflow of each of the projecting pieces formed at the tube elements at one end in a lengthwise direction or by cutting and raising the central portion perpendicularly. A pair of retaining portions are formed at specific positions at an external circumferential portion located at the sides of the heat exchanger relative to the direction of airflow to hold the two ends of the seal material with the pair of retaining portions.

14 Claims, 20 Drawing Sheets

HEAT EXCHANGER

BACKGROUND OF THE INVENTION

1. Field of the Invention

The present invention relates to a heat exchanger provided with a structure with which a seal material for filling the gap between the heat exchanger and the case in which the heat exchanger is housed is mounted at the heat exchanger for purposes such as preventing air from bypassing the heat exchanger via the gap.

2. Description of the Related Art

In a cooling unit constituting a portion of an air conditioning system, the gap formed between the inner wall of the case and the evaporator must be sealed off in order to, for instance, prevent air from bypassing the air conditioning system via the gap between the evaporator and the case so that the air conditioning system can perform to its full air conditioning capacity.

For this purpose, a structure whereby a foam body (the seal material as referred to in this application, which will also be referred to as such hereafter) is mounted at a heat exchanger along almost the entire circumference of the heat exchanger except for the air passage portion and also covering the two surfaces of the tanks at the air passage side, as disclosed in Japanese Unexamined Utility Model Publication No. S 55-51492, has already been developed.

In addition, in recent years, structures that facilitate the dismantling of automobiles into individual automotive parts so that they can be recycled as resources when automobiles are scrapped have been more readily adopted. This trend has been evident in the case of air conditioning systems mounted in automobiles, as well, and it has become increasingly desirable to facilitate the sorting of the heat exchanger parts according to their constituent materials, e.g., aluminum parts and parts constituted of materials other than aluminum, such as foam.

In the structure disclosed in the publication described above for mounting a foam body to a heat exchanger, since an integrated foam body is mounted at the heat exchanger, covering the entirety of the heat exchanger except for its air passage portion, it is difficult to remove the foam body, and this complicates the sorting of the heat exchanger parts according to constituent materials.

Because of this, in order to minimize waste produced at the time of scrapping, a structure in which a band-like elastic seal material (the seal material as referred to in this application, and referred to as such hereafter) is mounted by being wound around the external circumferential portion of a laminated heat exchanger, at the sides relative to the direction of the airflow, as disclosed in Japanese Unexamined Utility Model Publication No. H 4-73772, has been developed in recent years.

However, if a band-like seal material is simply mounted at a laminated heat exchanger, wound around the external circumferential portion at the sides relative to the direction of the airflow, the seal material becomes easily misaligned when the laminated heat exchanger is mounted in a case, thereby creating a new problem, i.e., the need for preventing such misalignment.

Thus, in order to prevent such misalignment of the seal material, in the heat exchanger disclosed in Japanese Unexamined Utility Model Publication No. H 4-73772, an elastic seal material is adhered to the external circumferential portion of the heat exchanger at the sides relative to the direction of the airflow.

However, it is extremely time consuming to peel off the elastic seal material adhering to the external circumferential portion of the heat exchanger, and since this results in the work process for sorting the heat exchanger parts according to their constituent materials more difficult, the recycling and re-utilization of manufacturing materials being may sometimes be skipped due to the difficulty of the sorting work and the expenses required for the sorting work in the worst case.

SUMMARY OF THE INVENTION

Accordingly, an object of the present invention is to provide a heat exchanger in which a band-like seal material is mounted at the heat exchanger by a means other than means for adhesion, such as an adhesive, to facilitate removal of the seal material when sorting the heat exchanger parts according to individual manufacturing materials, and in which the seal material is prevented from becoming misaligned at the external circumferential portion of the heat exchanger in the direction of the airflow when mounting the heat exchanger in a case and the like.

Thus, the heat exchanger according to the present invention, which is constituted at least by alternately laminating tube elements and corrugated fins and by mounting a band-like seal material wound around an external circumferential portion at the sides relative to the direction of the airflow, is provided with a guide at the external circumferential portion for clamping and holding the seal material.

This guide may be constituted by inwardly bending specific portions of projecting pieces located at the upper ends of the tube elements and extending out in the direction of the lamination so as to form the guide in the direction of the lamination of the tube elements. In addition, in another embodiment, the guide may be constituted by forming projecting pieces in the direction of the airflow extending in the direction of the lamination at the upper end portions of the tube elements in the lengthwise direction and directly cutting and raising a specific portion of each of the projecting pieces perpendicular to the direction of the airflow so that the guide is formed in the direction of the lamination of the tube elements. Furthermore, in another example, the guide may be constituted such that, in end plates located at both ends in the direction of the lamination, the end plate has a construction for accommodating fins and a part of each corner in the longitudinal direction of the end plate is distended, so that the guide is formed in the direction of the length of the end plate. In another example, the guide may be constituted so that, in end plates at both ends in the direction of the lamination, a raised portion is provided parallel to the direction of the length of the end plate, so that the guide is formed in the direction of the length of the plate. In yet another example, the guide may be constituted such that, in a pair of tanks formed at the lower end of a tube element in the direction of its length, a portion between the tanks is notched, so that the guide is formed in the direction of the lamination of the tube elements.

Thus, the seal material mounted at the external circumferential portion at the sides relative to the direction of the airflow in the heat exchanger is clamped and held at both sides by the guide formed in the direction of the lamination or in the direction of the length of the end plate at the external circumferential portion, the seal material never becomes misaligned in the direction of the airflow at the external circumferential portion, thereby eliminating the necessity for bonding the seal material to the heat exchanger by a securing means such as an adhesive. In addition, by fitting the seal material with the guide, its position can be fixed, thereby facilitating the mounting of the seal material.

Alternatively, the heat exchanger according to the present invention, which is constituted at least by laminating tube elements and corrugated fins alternately and winding a band-like seal material around an external circumferential portion of the heat exchanger at the sides relative to the direction of the airflow, is provided with a plurality of retaining portions for hooking the seal material at the external circumferential portion. It is to be noted that at least one pair of retaining portions are formed so that the band-like seal material can be hooked at its two ends.

In this structure, the seal material is mounted, wound around the external circumferential portion of the heat exchanger by hooking the end portion of the band-like seal material at one side at one retaining portion formed at a specific position at the external circumferential portion of the heat exchanger, pulling the seal material sequentially along the external circumferential portion of the heat exchanger and hooking the end portion of the seal material at the other side at another retaining portion formed at a specific position at the external circumferential portion.

The retaining portions are formed by placing an end plate at an end in the direction of the lamination with an area at the end of the end plate in the direction of its length projecting out. Thus, with the retaining portions formed at one side of the ends of the two end plates in the direction of their lengths, the seal material is wound around the heat exchanger by first hooking the end of the seal material at the retaining portion at one side in one of the end plates, pulling the seal material along the side surface of this end plate to the end at the side where the retaining portion is not formed, then pulling the seal material along the external circumferential portion of the heat exchanger to the other end plate in the direction of the lamination, further pulling it along the side surface of the other end plate to the end at the side where the retaining portion is formed and finally hooking the other end of the seal material at the retaining portion at the other end plate.

Or, the retaining portions may instead be formed by placing end plates provided with projecting portions for accommodating fins at the ends in the direction of the lamination by cutting and raising continuous connecting portions between the projecting portions and non-projecting portions of the end plates. With this structure, in which the retaining portions are formed at the continuous connecting portions of the two end plates, the seal material is wound around the heat exchanger by first hooking the end of the seal material at one side at the retaining portion in one end plate, pulling the seal material along the side surface of this end plate to the end at one side, then pulling it along the external circumferential portion of the heat exchanger to an end of the other end plate in the direction of the lamination, further pulling it along the side surface of the other end plate to the end at the other side and finally hooking the other end of the seal material at the retaining portion formed at the other end plate.

Furthermore, the retaining portions may be formed with an area between a pair of tanks formed at one end of a tube element located at a specific position in its lengthwise direction, projecting out in the lengthwise direction. In this case, the retaining portions are formed between the tanks of two tube elements separated by a specific distance. In the heat exchanger provided with these retaining portions, the seal material is mounted at the heat exchanger by first hooking the end of the seal material at one side at the retaining portion of one of the tube elements provided with the retaining portions, pulling the seal material along the area between the tanks to one end in the direction of the lamination at the side opposite from the other tube element, further pulling it around along the external circumferential portion of the heat exchanger to one side of the heat exchanger in the direction of the lamination, to the side of the heat exchanger opposite from the tanks and to the other side of the heat exchanger in the direction of the lamination, pulling it from the tank side position at the other end of the heat exchanger in the direction of the lamination to the other tube element having the retaining portion along the area between the tanks in the direction of the lamination and finally hooking the seal material at the retaining portion formed between the tanks at the other tube element.

Moreover, each retaining portion may instead be constituted by forming a projecting piece extending in the direction of the lamination at the upper end of a tube element in its lengthwise direction and cutting and raising the projecting piece almost perpendicular to the direction of the airflow. Thus, with the retaining portions formed at the projecting pieces of two tube elements separated over a specific distance, the seal material is mounted at the heat exchanger by first hooking the end of the seal material at one side at the retaining portion formed at the projecting piece in one of the tube elements, pulling the seal material to the end at the side opposite from the other tube element having the retaining portion in the direction of the lamination, then pulling it around along the external circumferential portion of the heat exchanger to the side surface of the heat exchanger at one end in the direction of the lamination, to the area between the tank portions of the heat exchanger and to the side surface of the heat exchanger at the other end in the direction of the lamination, further pulling it from the end portion of the side surface at the other end toward the projecting piece to the other tube elements along the projecting piece in the direction of the lamination and finally hooking it at the retaining portion formed at the projecting piece of the other tube element.

Furthermore, the retaining portions may instead be formed by directly cutting and raising a portion of a side surface of an end plate provided at a trailing end in the direction of the lamination where the seal material is wound around in the direction of the length of the end plate. Thus, with retaining portions formed over a specific interval at the center of one of the end plates in the direction of the length, the seal material is wound around the heat exchanger by first hooking the end of the seal material at one side at one of the retaining portions of the end plate, pulling the seal material along the side surface of the end plate in the direction opposite from the other retaining portion to the end of the end plate at one side, then pulling it around along the external circumferential portion of the heat exchanger to the end of the end plate at the other side and finally hooking the other end of the seal material at the other retaining portion of the end plate.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

The following is an explanation of embodiments of the present invention in reference to the drawings.

Figure 1:
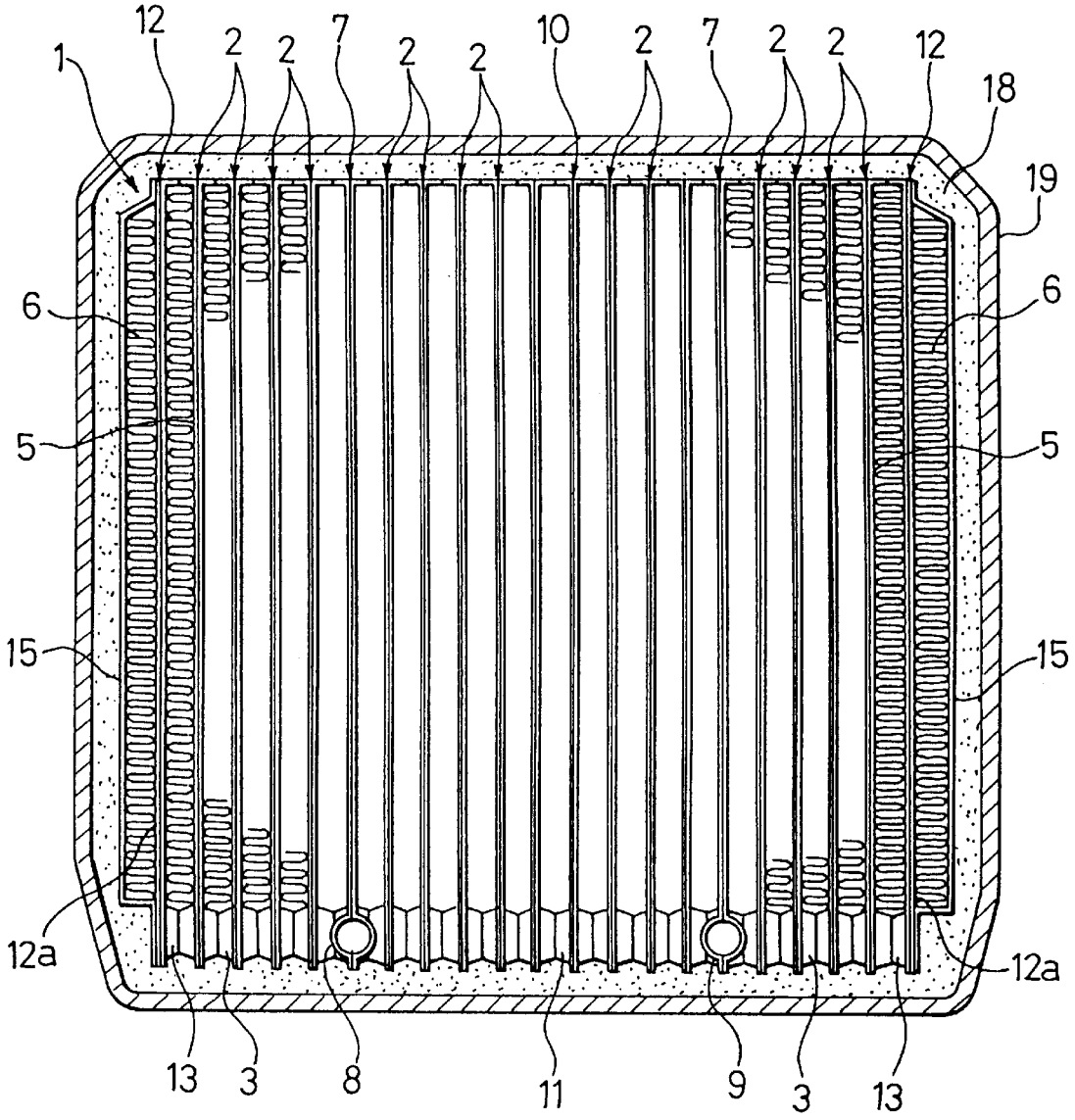
FIG. 1 is a front view of a laminated heat exchanger housed in a case, with a band-like seal material mounted, by being around an external circumferential portion of the laminated heat exchanger located at the sides relative to the direction of the airflow.
Figure 2:
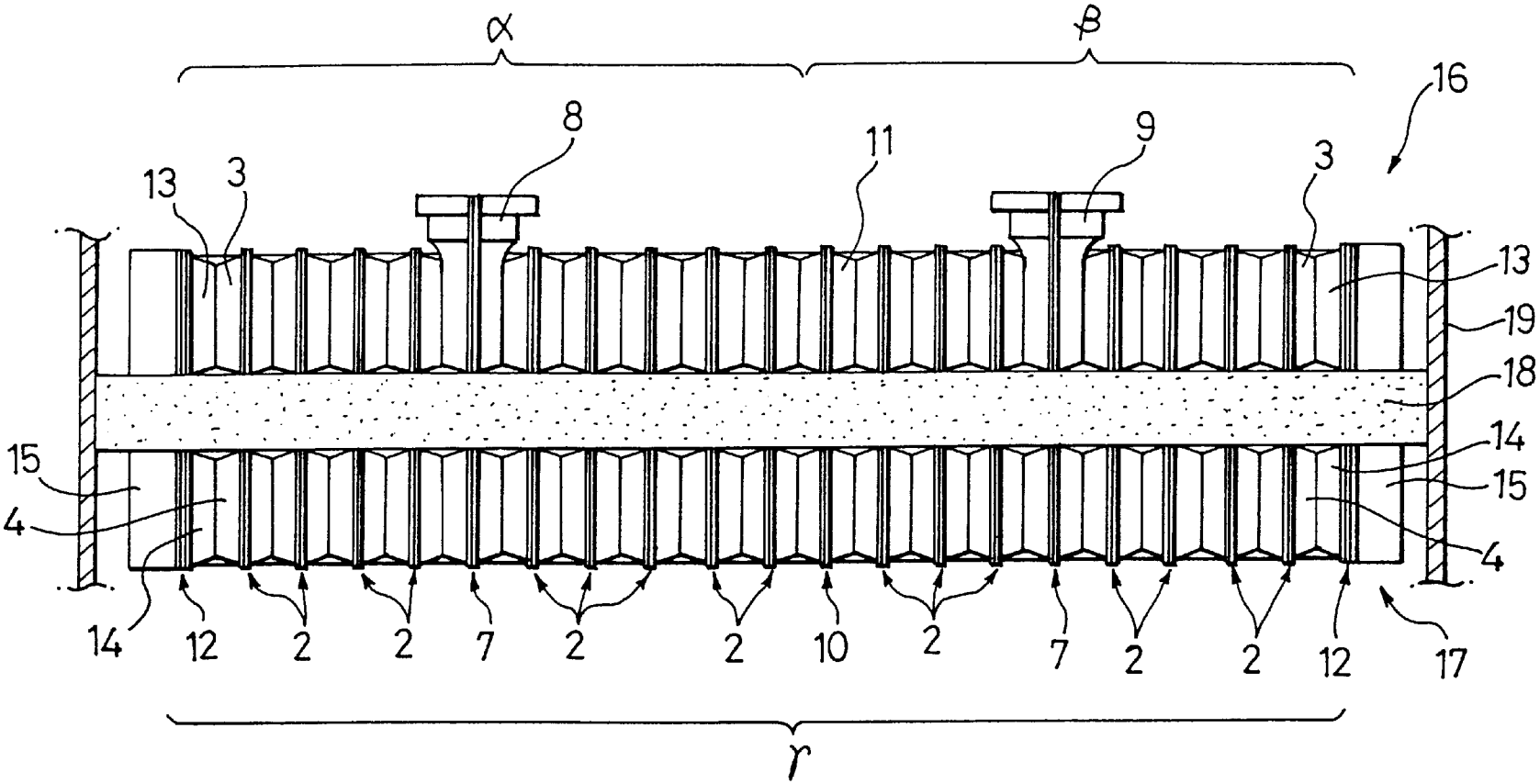
FIG. 2 is a bottom view of a laminated heat exchanger housed in a case, with a band-like seal material mounted, by being around an external circumferential portion of the laminated heat exchanger located at the sides relative to the direction of the airflow.

A laminated heat exchanger 1 shown in FIGS. 1 and 2, which may be employed as, for instance, an evaporator in an air conditioning system for vehicles, is basically constituted by alternately laminating over a plurality of levels, tube elements with corrugated fins. The tube elements include first tube elements 2, each having a pair of tanks 3 and 4 formed at an end in the direction of the lamination thereof, a U-shaped heat exchanging medium passage 5 which communicates between the tanks 3 and 4, a pair of second tube elements 7 located at specific positions among the first tube elements (sixth from either side) each having an inflow portion 8 or an outflow portion 9 projecting out from a tank 3 in the direction of the airflow, a third tube element 10 located at approximately the center in the direction of the lamination having a blind tank 11 instead of the tank 3 and fourth tube elements 12 each located at either end in the direction of the lamination having tanks 13 and 14 whose capacities are approximately half those of the tanks 3 and 4 with a flat plate 12*a* placed at one side. It is to be noted that the second through fourth tube elements 7, 10 and 12, too, are each provided with a U-shaped heat exchanging medium passage 5 identical to those of the tube elements 2.

Thus, with the first tube elements 2, the second tube elements 7 and the third tube element 10 laminated as appropriate and the fourth tube elements 12 provided at the two sides in the direction of the lamination, a tank group 16 comprising the tanks 3, the blind tank 11 and the tanks 13 is divided into a first tank block $\alpha$ having the inflow portion 8 and a second tank block $\beta$ having the outflow portion 9, and a second tank group 17 comprising the tanks 4 and the tank 14 constitutes a third tank block $\gamma$ with all the tanks being in communication with no partitioning.

In this structure, the heat exchanging medium having flowed in through the inflow portion 8, enters the tank 3 of the second tube element 7, becomes dispersed throughout the entire first tank block $\alpha$ via communicating holes (not shown) and flows upward through the heat exchanging medium passages 5 at the side of the tank group 16 that constitutes the first tank block $\alpha$. Then, it makes a U-turn at the top of the heat exchanging medium passages 5 before traveling downward to reach the tank group 17 (the third tank block $\gamma$) at the opposite side. After this, it flows to the remaining portion of the tank group 17 constituting the third tank block $\gamma$ via communicating holes (not shown). Then, it flows upward along the heat exchanging medium passages 5 corresponding to the remaining portion of the tank group 17 constituting the third tank block $\gamma$. Then, it makes a U-turn at the top of the heat exchanging medium passages 5 before traveling downward and into the portion of the tank group 16 constituting the second tank block $\beta$. Finally, the heat exchanging medium that has thus flowed to the tank group 16 is gathered at the tank 4 where the outflow portion 9 is provided to flow out through the outflow portion 9. Thus, the heat carried in the heat exchanging medium is communicated to the fins 6 during the process in which it flows through the heat exchanging medium passages 5, so that heat exchange is performed with the air passing between the fins 6.

Now, this laminated heat exchanger 1 is provided with a band-like seal material 18 wound around at an external circumferential portion thereof at the sides relative to the direction of the airflow so that when the laminated heat exchanger 1 is housed within a case 19, the gap between the case 19 and the laminated heat exchanger 1 is closed off by the seal material 18 to prevent air that is not employed in heat exchange by the laminated heat exchanger 1 from bypassing.

FIGS. 3 through 8 show embodiments of a guide 20 for holding the seal material 18 when mounting the seal material 18 at the laminated heat exchanger 1. The following is an explanation of the structures of different examples of the guide 20.

Figure 3:
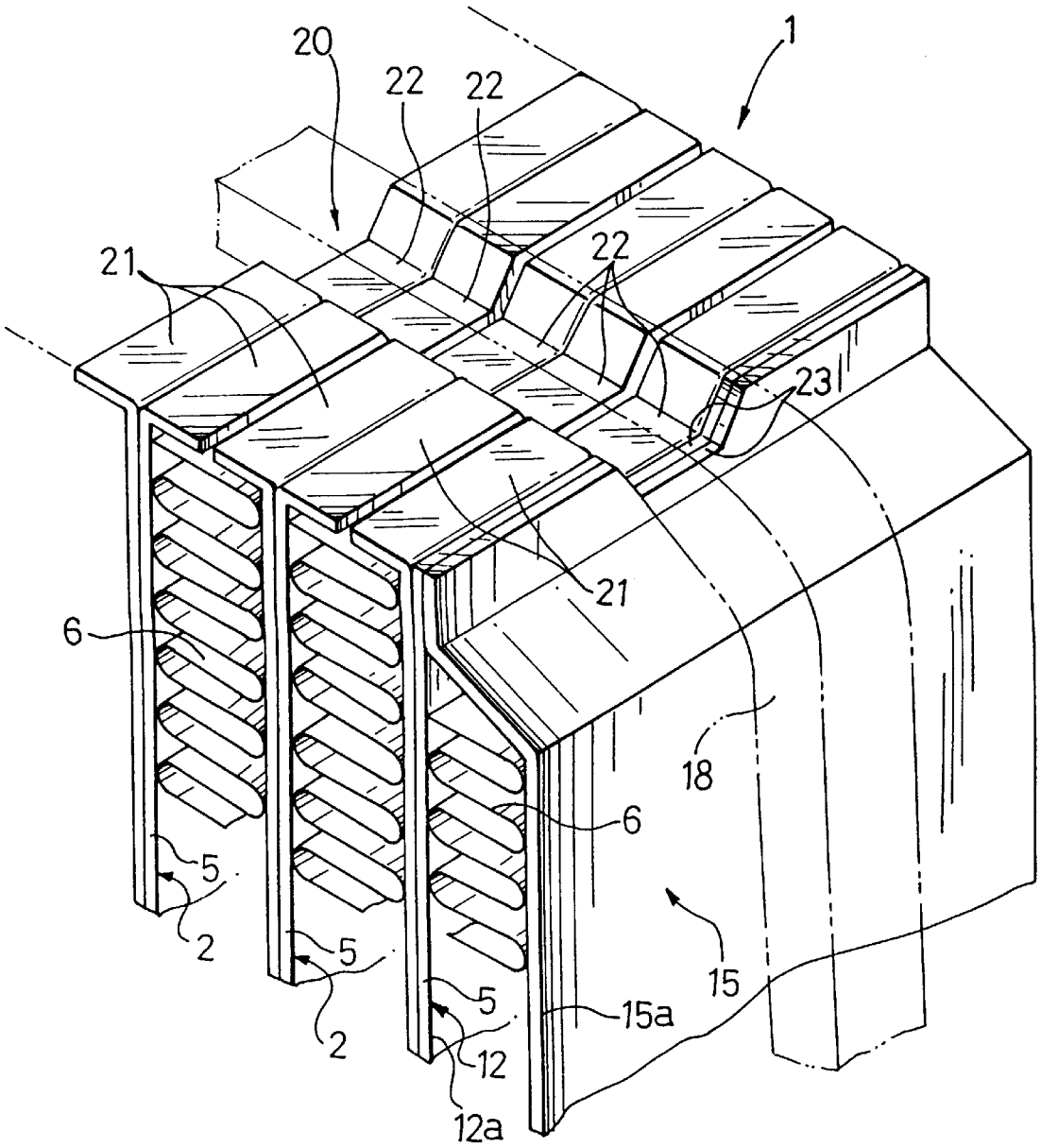
FIG. 3 illustrates a guide for the seal material, formed by indenting projecting pieces formed at the front end portions of the tube elements.

In FIG. 3, the laminated heat exchanger 1 is provided with projecting pieces 21 and 21 extending at the two sides of each of the first tube elements 2 in the direction of the lamination at the upper end portion in the lengthwise direction in order to prevent the fins 6 from falling out. It is to be noted that, although not shown, the second and third tube elements 7 and 10, too, are each provided with projecting pieces 21 extending inward in the direction of the lamination at the upper end portions in the lengthwise direction. The fourth tube elements 12, too, are each provided with a projecting piece 21 extending inward in the direction of the lamination at the upper end portion in the lengthwise direction as shown in FIG. 3.

It is to be noted that while FIG. 3 shows an end plate 15 having a projecting portion 15*a* for accommodating fins 6 to the outside of the fourth tube element 12 in the direction of the lamination, the shape of the end plate 15 is not limited to this, and the only requirement for the end plate 15 is that it form an external circumferential portion around which the band-like seal material 18 can be wound. For instance, a flat plate 12*a* located to the outside of the fourth tube element 12 in the direction of the lamination itself may be used as an end plate.

At each of the projecting pieces 21 of the tube elements 2, 7, 10 and 12, an indented portion 22 is formed by bending the approximate central portion in the direction of the airflow inward and with this, when the tube elements 2, 7, 10 and 12 are laminated, an indented groove-like guide 20 is formed extending in the direction of the lamination.

If the end plate 15 is to be placed outside of the flat plate 12*a* constituting the tube element 12, this end plate 15 will have a notch 23 formed to match the shape of the indented portions 22 of the projecting pieces 21.

Thus, when the band-like seal material 18 is fitted inside the guide 20, the seal material 18 is held at both sides in the direction of the airflow at the side edges of the indented portions 22 of the projecting pieces 21, thereby preventing the seal material 18 from becoming misaligned in the direction of the airflow.

Figure 4:
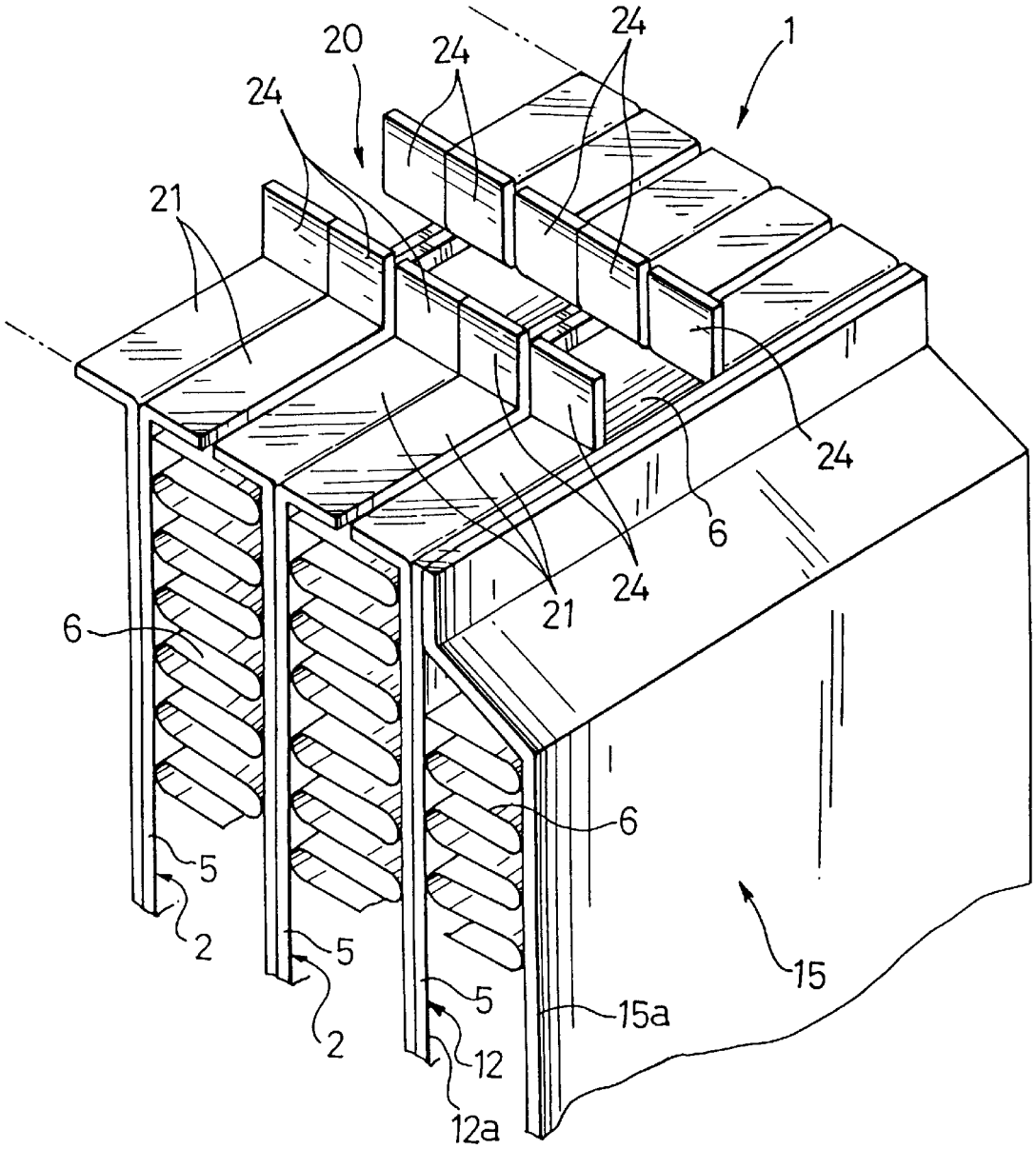
FIG. 4 illustrates a guide for the seal material, formed by cutting and raising projecting pieces formed at the front end portions of the tube elements.

In FIG. 4, the laminated heat exchanger 1 is provided with projecting pieces 21 and 21 extending at the two sides of each of the first tube elements 2 in the direction of the lamination at the upper end portion in the lengthwise direction in order to prevent the fins 6 from falling out. It is to be noted that, although not illustrated in the figure, the second and third tube elements 7 and 10, too, are each provided with projecting pieces 21 extending at both sides in the direction of the lamination at the upper end portions in the lengthwise direction. In addition, the fourth tube elements 12, too, are each provided with a projecting piece 21 extending inward in the direction of the lamination at the upper end portion in the lengthwise direction, as shown in FIG. 4. It is to be noted that, as in the embodiment illustrated in FIG. 3, the structure of the end plate 15 is not limited to that shown in FIG. 4 and the flat plate 12*a* may itself be used as an end plate since the only requirement for the end plate is that it constitute an external circumferential portion around which the band-like seal material 18 can be wound.

At each of the projecting pieces 21 of the tube elements 2, 7, 10 and 12, erect pieces 24 and 24 are formed parallel to each other over a distance which is approximately equal to the lateral width of the seal material 18 by cutting and raising the central portion in the direction of the airflow. Thus, when those tube elements 2, 7,10 and 12 are laminated, a guide 20 enclosed by two rows of walls extending parallel to each other in the direction of the lamination is formed.

When the band-like seal material 18 is fitted inside the guide 20, the seal material 18 is held at both sides in the direction of the airflow by the walls of the guide 20, i.e., the erect pieces 24 and 24 of the projecting pieces 21, so that the seal material 18 is prevented from becoming misaligned in the direction of the airflow.

Figure 5:
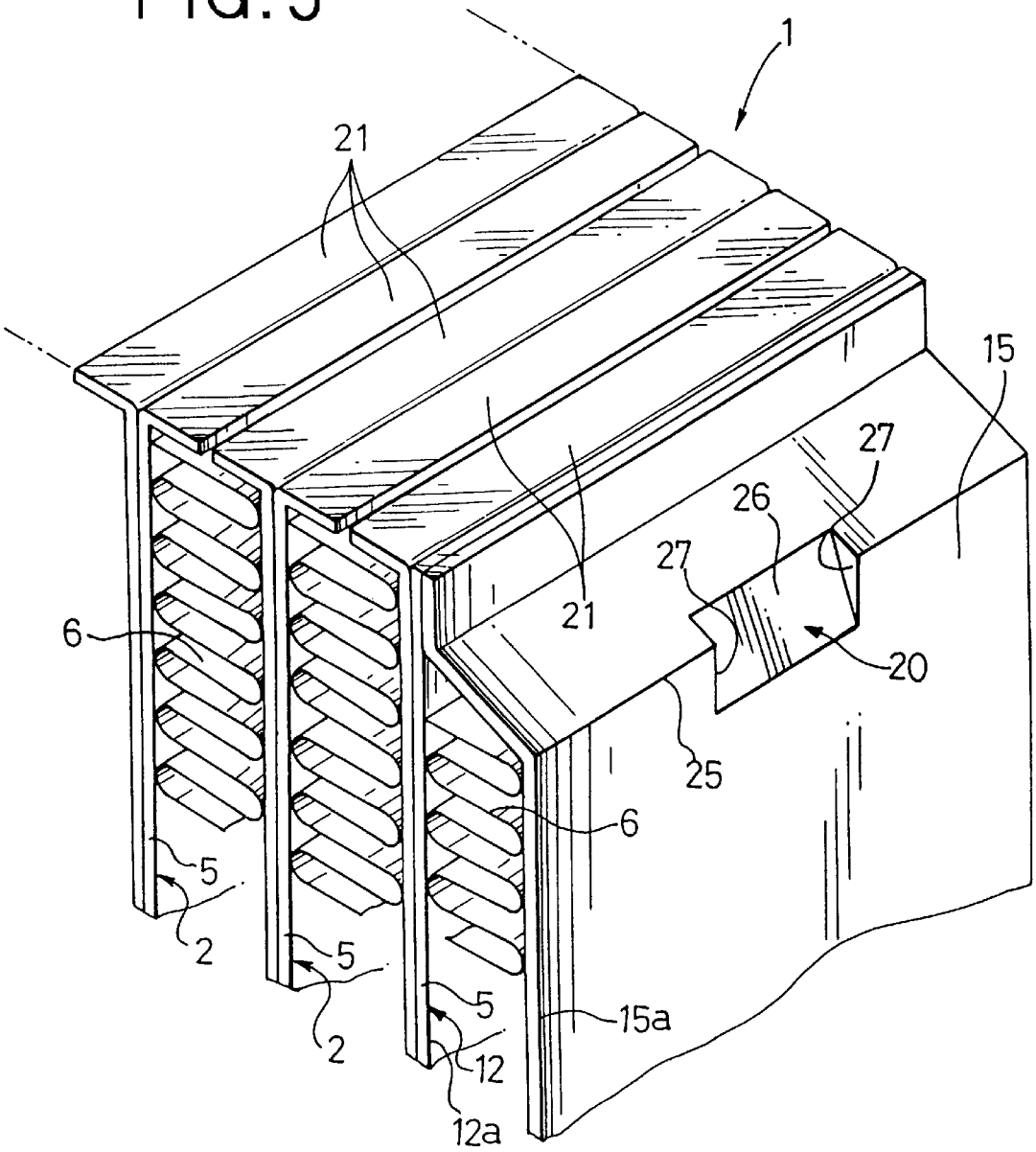
FIG. 5 illustrates a guide for the seal material, formed by indenting a comer of the projecting portion of an end plate.

In FIG. 5, the laminated heat exchanger 1 is provided with an end plate 15 having a projecting portion 15*a* for accommodating fins 6 at the trailing end of the tube element 12 in the direction of the lamination. It is to be noted that, while, in FIG. 5, projecting pieces 21 extending in the direction of the lamination are formed at the upper end portions of the tube elements 2 and 12, any structure that ensures that the fins 6 are prevented from falling out may be adopted instead, as long as an external circumferential portion around which the band-like seal material 18 can be wound is constituted.

In the end plate 15, by indenting an upper comer portion 25 of the projecting portion 15*a* over a width that is approximately equal to that of the seal material 18 during forming, a guide 20 having an indented portion 26 and edge sides 27 and 27 at the two sides of the indented portion 26 is formed.

When the band-like seal material 18 is fitted in such a manner that it is in contact with the indented portion 26 of the guide 20, the seal material 18 is held at both sides in the direction of the airflow by the two edge sides 27 and 27 to prevent the seal material 18 from becoming misaligned in the direction of the airflow.

Figure 6:
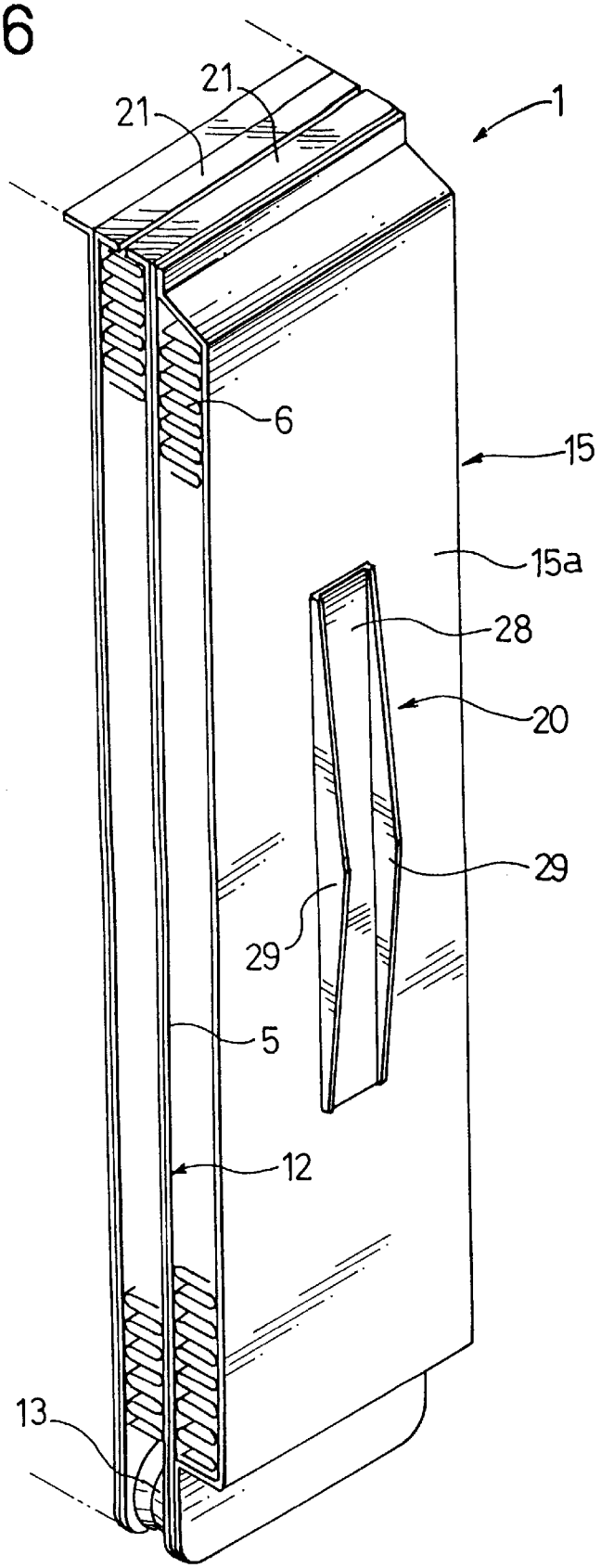
FIG. 6 illustrates a guide for the seal material, formed by providing plate-like raised portions at a side surface of an end plate parallel to the direction of the length of the end plate.

In FIG. 6, the laminated heat exchanger 1 is provided with an end plate 15 at the trailing end of the tube element 12 in the direction of the lamination. It is to be noted that while, in FIG. 6, the end plate 15 is provided with a projecting portion 15*a* for accommodating the fins 6, its structure is not limited to this, and as long as it constitutes an external circumferential portion around which the band-like seal material 18 can be wound, a flat end plate, for instance, may be used instead. In addition, while a projecting piece 21 is formed at the tube element 12, as long as an external circumferential portion around which the band-like seal material 18 can be wound is constituted, any structure that ensures that the fins 6 are prevented from falling out may be adopted instead. It is to be noted that, although not illustrated in the figure, the same structural concept applies to the other projecting pieces 21 formed at the tube elements 2, 7, 10 and 12.

A plate 28 having triangular raised portions 29 and 29 parallel to each other standing erect over a distance which is approximately equal to the width of the seal material 18 is mounted at a side surface of the end plate 15 in such a manner that the direction in which the raised portions 29 and 29 extend is aligned with the direction of the length of the end plate 15, to form a guide 20.

When the band-like seal material 18 is fitted in contact with the plate 28 of the guide 20, the seal material 18 is held at both sides in the direction of the airflow by the raised portions 29 at the two sides to prevent the seal material 18 from becoming misaligned in the direction of the airflow.

Figure 7:
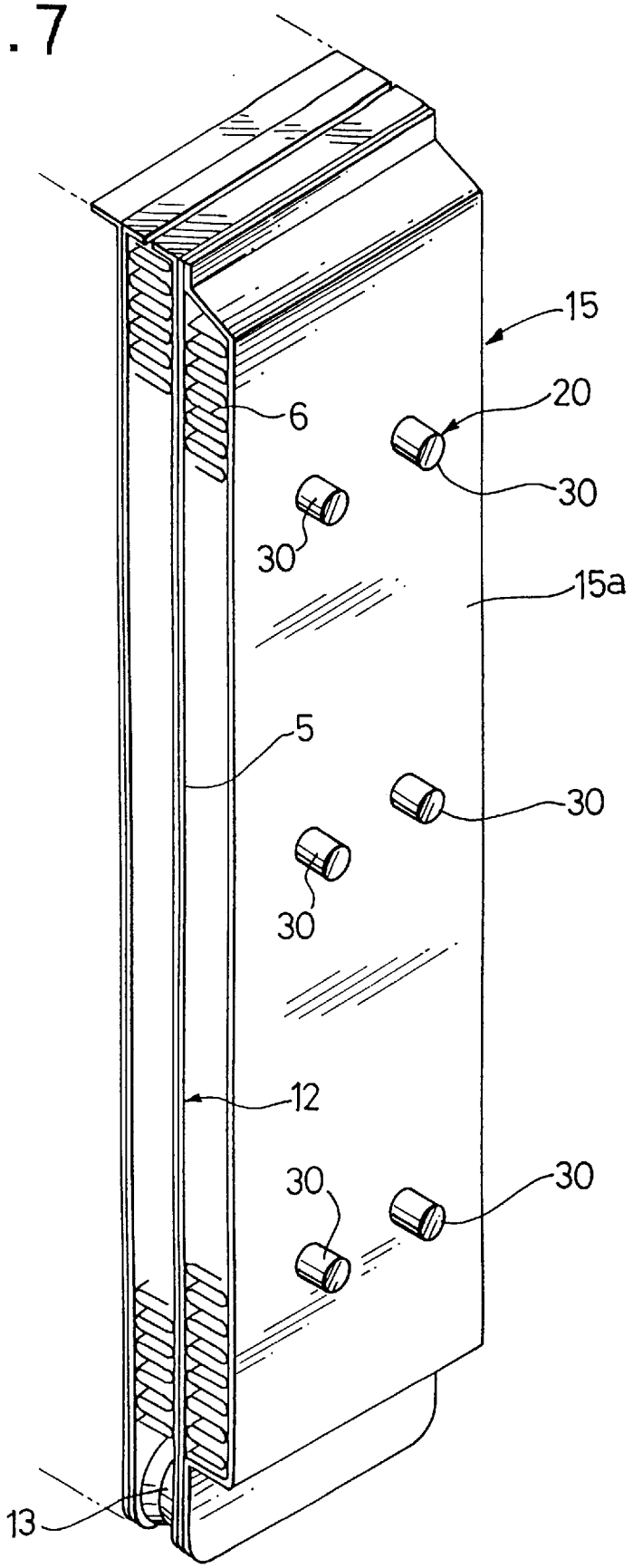
FIG. 7 illustrates a guide for the seal material formed by providing cylindrical raised portions at a side surface of an end plate parallel to the direction of the length of the end plate.

In FIG. 7, too, the laminated heat exchanger 1 is provided with an end plate 15 at the trailing end of the tube element 12 in the direction of the lamination. It is to be noted that as in the embodiment illustrated in FIG. 6, no particular restrictions are imposed in regard to the presence/absence of the projecting portion 15*a* at the end plate 15 or the structure of the projecting piece 21 at the tube element as long as an external circumferential portion around which the band-like seal material 18 can be wound is constituted.

A plurality of pairs of cylindrical raised portions 30 are provided at a side surface of the end plate 15 parallel to the direction of the length of the end plate 15, with the raised portions 30 of each pair positioned over a distance from each other that is approximately equal to the width of the seal material 18, to form a guide 20.

Thus, when the band-like seal material 18 is fitted in contact with the end plate 15 between the raised portions of the guide 20, the seal material 18 is held at both sides in the direction of the airflow by the raised portions 30 to prevent the seal material 18 from becoming misaligned in the direction of the airflow.

Figure 8:
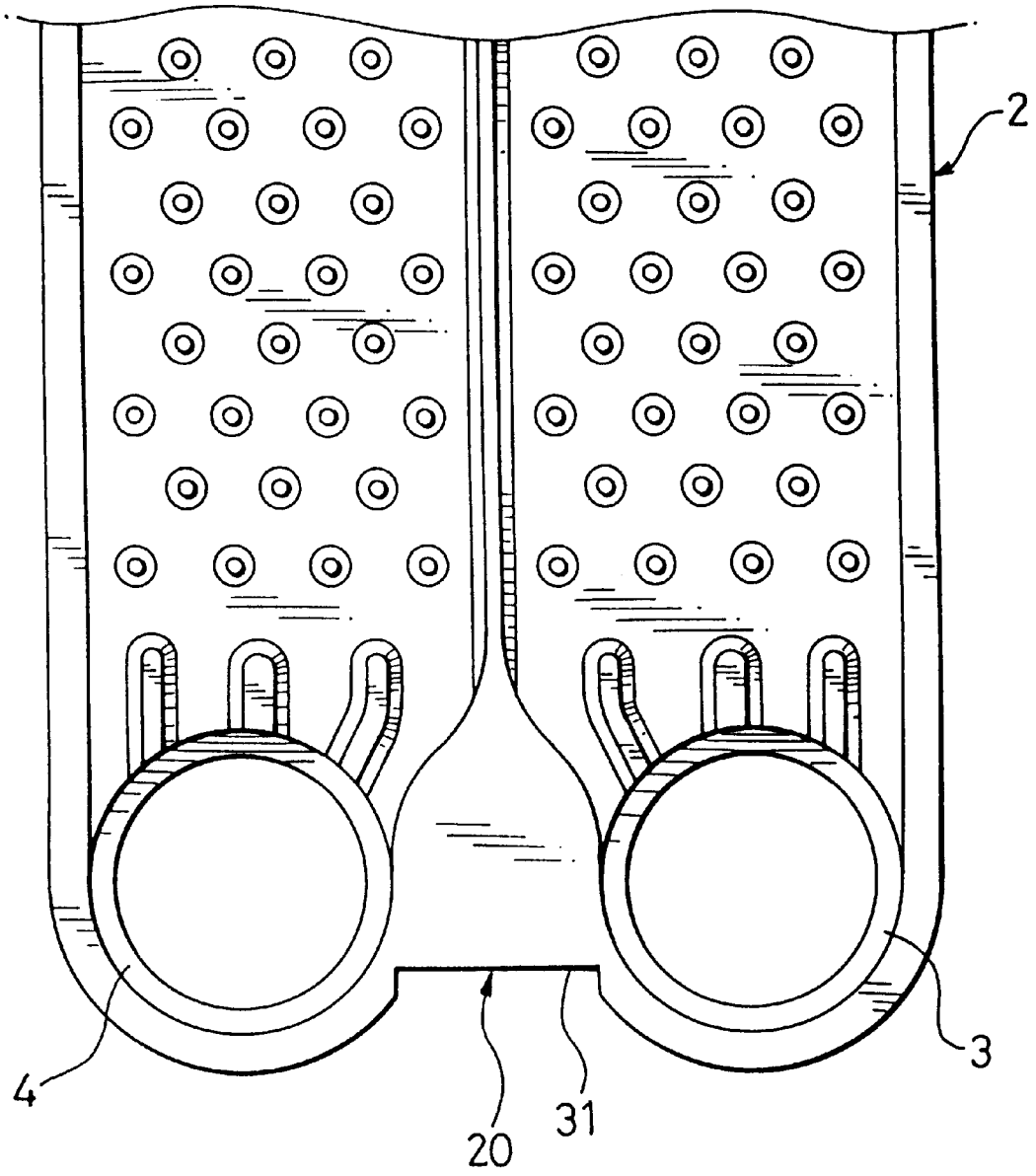
FIG. 8 illustrates a guide for the seal material, formed by notching the area between tanks at the trailing end of a tube element.

In FIG. 8, a laminated heat exchanger 1 is provided with an indentation 31 formed by notching the area between the adjacent tanks 3 and 4 or the area between the tanks 13 and 14 of each tube element 2 (or each of the tube elements 7,10 and 12), in a rectangular shape. It is to be noted that, although not shown, the tube elements 7,10 and 12, too, are each provided with an indentation similar to those of the tube elements 2 formed by notching the area between the tanks in a rectangular shape. If an end plate 15 is to be provided at a trailing end in the direction of the lamination, the end plate 15, too, is provided with a notched indented portion (not shown) matching the indentations 31 at its trailing end portion.

Thus, by laminating the tube elements 2, 7, 10 and 12 and laminating the end plate 15 as well, as necessary, a groove-like guide 20 extending in the direction of the lamination is formed.

When the band-like seal material 18 is fitted in contact with the upper edges of the indentations 31 constituting the guide 20, the seal material 18 is held at both sides in the direction of the airflow by the side edges of the indentations 31 to prevent the seal material 18 from becoming misaligned in the direction of the airflow.

As has been explained, with the structures of the guide 20 illustrated in FIGS. 3 through 8, since the necessity for a means for securing such as an adhesive for mounting the seal material 18 is eliminated and the seal material 18 can be mounted simply by being fitted in the guide 20, the seal material 18 can be removed from the laminated heat exchanger 1 easily when disposing of the laminated heat exchanger 1, thereby achieving a simplification of the sorting operation for sorting the parts of the laminated heat exchanger 1 into constituent materials.

In addition, with the structures of the guide 20 illustrated in FIGS. 3 through 8, since the position at which the seal material 18 is to be wound around can be determined simply by fitting the seal material 18 in the guide 20, mounting of the seal material 18 is facilitated.

It is to be noted that, while five embodiments are presented as examples of the guide 20, a plurality of the embodiments of the guide 20 may be adopted in combination to further enhance the function of holding the seal material 18.

As has been explained, in this heat exchanger, since the band-like seal material wound around at an external circumferential portion at the sides relative to the direction of the airflow is clamped and held at both sides of a guide formed in the direction of the lamination at the external circumferential portion or in the lengthwise direction of the end plate, the seal material is prevented from becoming misaligned in the direction of the airflow and, at the same time, since the seal material is simply held by the guide, the seal material can be removed from the heat exchanger easily, thereby facilitating sorting of the materials for recycling.

In addition, since the position of the seal material can be determined simply by fitting the seal material in the guide, the mounting of the seal material is simplified.

Furthermore, the laminated heat exchanger (hereafter referred to as the heat exchanger) 101 shown in FIGS. 9, 10, 14, 16, 18 and 20, too, is employed as, for instance, an evaporator in an air conditioning system for vehicles, as in the case of the heat exchanger disclosed earlier, and is basically constituted by alternately laminating over a plurality of levels (21 levels, for instance) tube elements and corrugated fins 106. The tube elements include first tube elements 102 each having a pair of tanks 103 and 104 formed at one end in the lengthwise direction, a U-shaped heat exchanging medium passage 105 which communicates between the tanks 103 and 104, second tube elements 107 located at specific positions among the laminated first tube elements 102 (sixth from either side) each having an inflow portion 108 or an outflow portion 109 projecting out from the tank 103 in the direction of the airflow, a third tube element 110 located at approximately the center in the direction of the lamination, having a blind tank 111 instead of the tank 103 and fourth tube elements 112 each located at either end in the direction of the lamination, having tanks 113 and 114 whose capacities are approximately half those of the tanks 103 and 104 with a flat plate 112*a* placed at one side. It is to be noted that the second through fourth tube elements 107,110 and 112 too, are each provided with a U-shaped heat exchanging medium passage 105 identical to those of the first tube elements 102.

Thus, with the first tube elements 102, the second tube elements 107 and the third tube element 110 laminated as appropriate and the fourth tube elements 112 provided at the two sides in the direction of the lamination, a first tank group 116 comprising the tanks 103, the blind tank 111 and the tanks 113 is divided into a first tank block $\alpha 2$ having the inflow portion 108 and a second tank block $\beta 2$ having the outflow portion 109, and a second tank group 117 comprising the tanks 104 and the tanks 114 constitutes a third tank block $\gamma 2$ with all the tanks in communication with no partitioning.

In this structure, the heat exchanging medium having flowed in through the inflow portion 108, enters the tank 103 of the second tube element 107, becomes dispersed throughout the entire first tank block $\alpha 2$ via communicating holes (not shown) and flows upward through the heat exchanging medium passages 105 at the side of the tank group 116 that constitutes the first tank block $\alpha 2$. Then, it makes a U-turn at the top of the heat exchanging medium passages 105 before traveling downward to reach the tank group (the third tank block $\gamma 2$) at the opposite side. After this, it flows to the remaining portion of the tank group 117 constituting the third tank block $\gamma 2$ via communicating holes (not shown). Then, it flows upward along the heat exchanging medium passage 105 corresponding to the remaining portion of the tank group 117 constituting the third tank block theta2. Then, it makes a U-turn at the top of the heat exchanging medium passages 105 before traveling downward and into the portion of the tank group 116 constituting the second tank block $\beta 2$. Finally, the heat exchanging medium that has thus flowed to the tank group 116 is gathered at the tank 104 where the outflow portion 109 is provided to flow out through the outflow portion 109. Thus, the heat carried in the heat exchanging medium is communicated to the fins 106 during the process in which it flows through the heat exchanging medium passages 105, so that heat exchange is performed with the air passing between the fins 106 and 106.

Now, when this heat exchanger 101, with a band-like seal material 118 mounted by means of retaining portions 120 (to be detailed below) wound around at an external circumferential portion at the sides relative to the direction of the airflow, is housed inside a case (not shown), the gap between the case and the heat exchanger 101 is closed off by the seal material 118 to prevent air from bypassing without being employed in heat exchange by the heat exchanger 101. The following is an explanation of various structures that may be adopted for the retaining portions for retaining the seal material 118.

Figure 9:
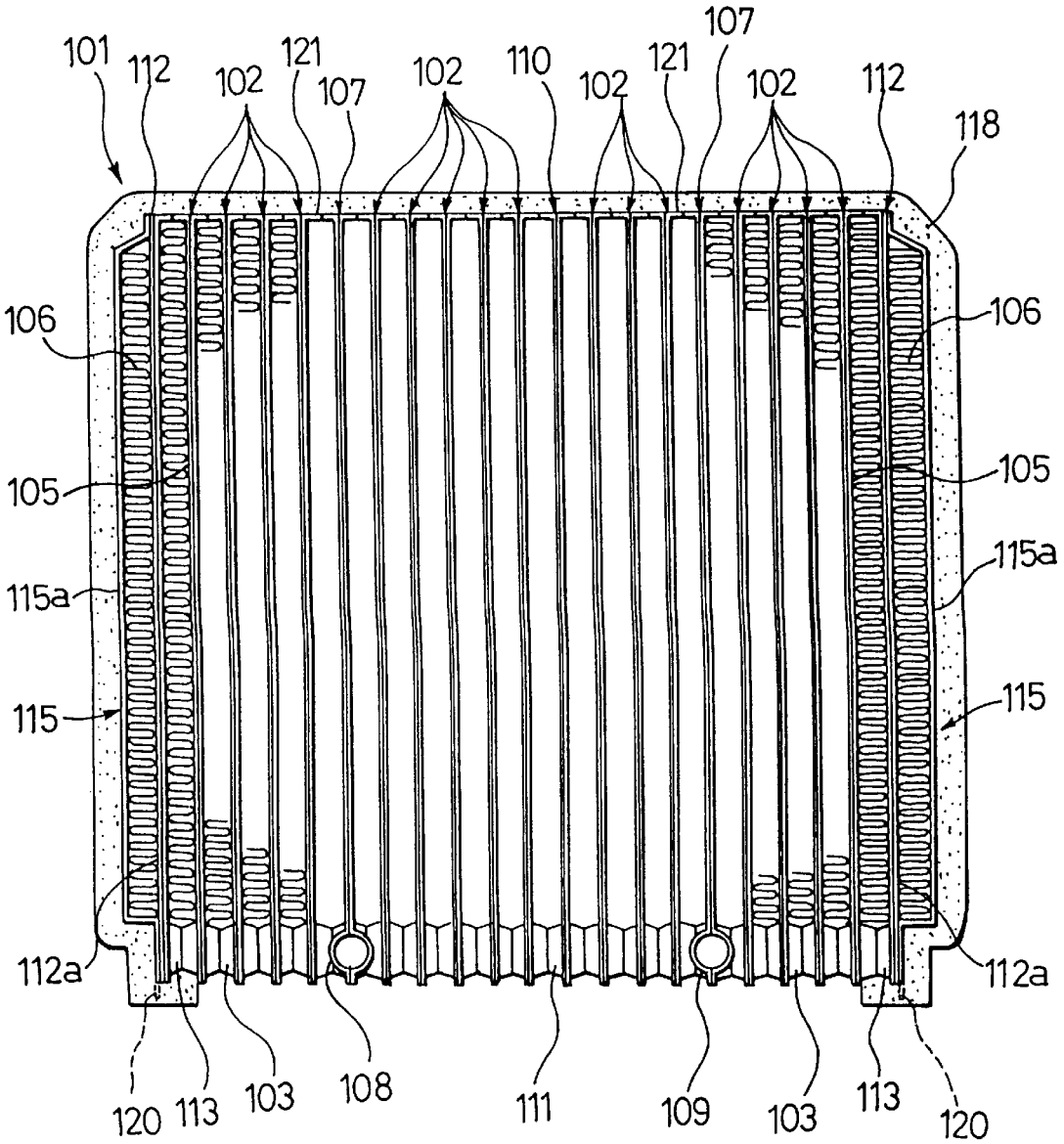
FIG. 9 is a front view of a heat exchanger with retaining portions formed at the end plates at their end portions toward the tanks, with seal material mounted.
Figure 10:
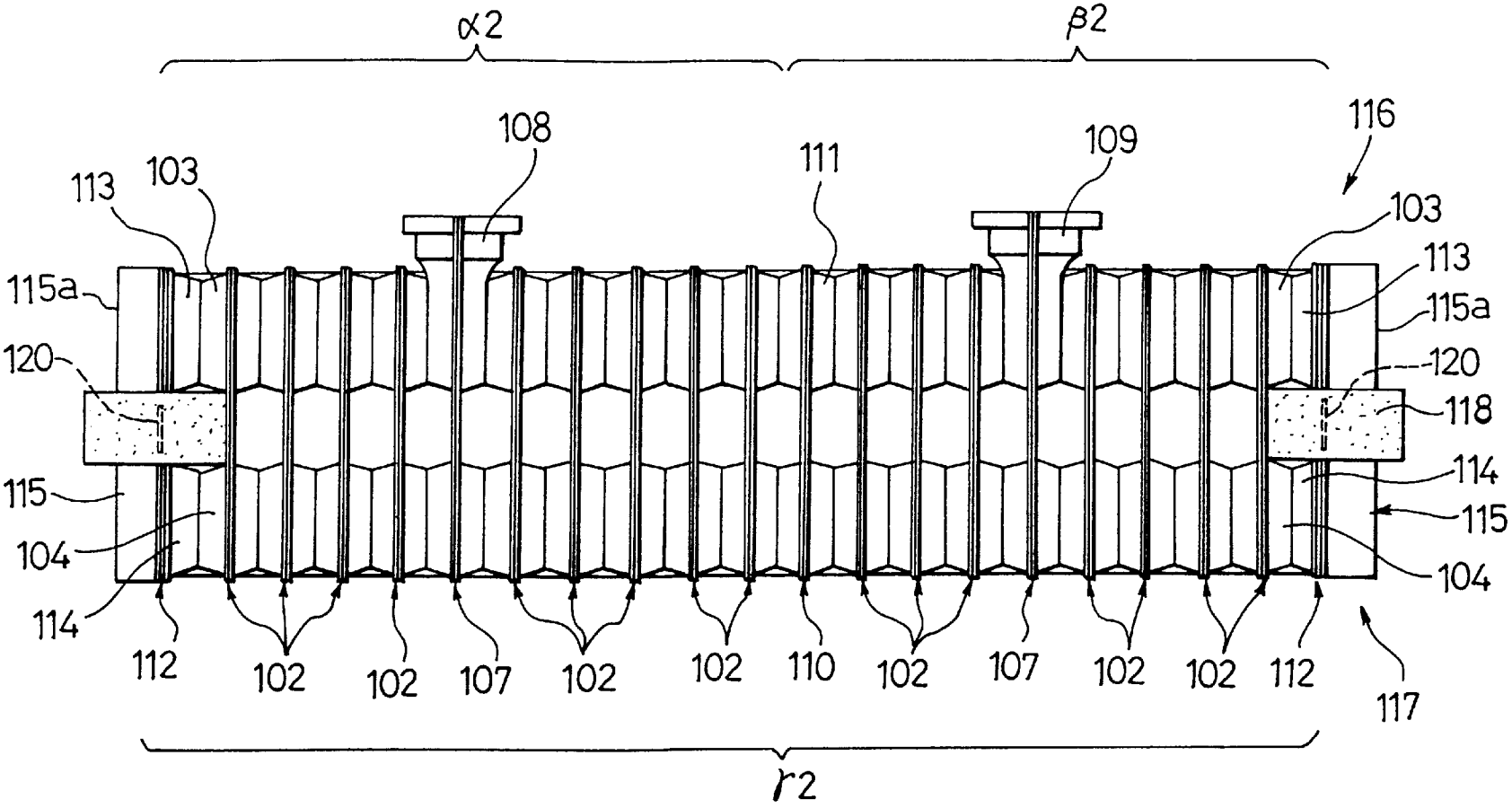
FIG. 10 is a bottom view of the heat exchanger above, with seal material mounted.
Figure 11:
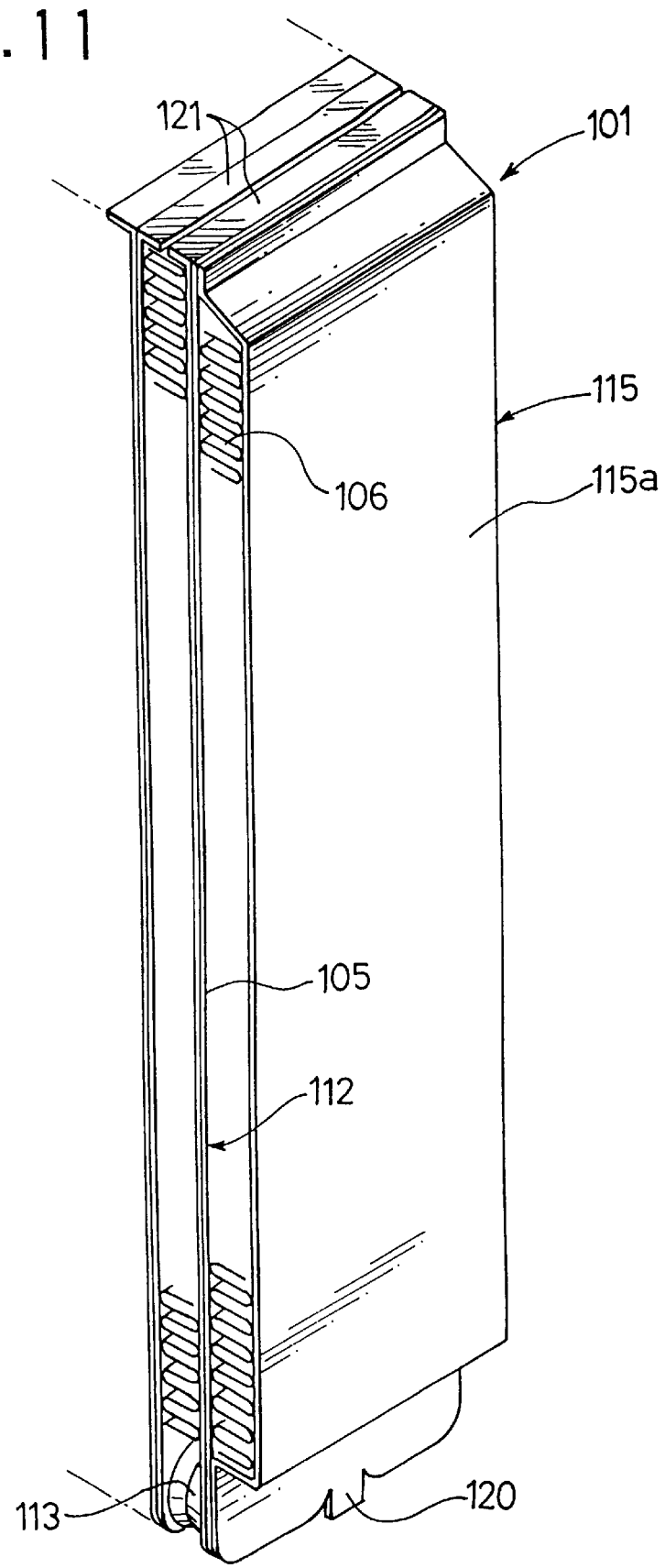
FIG. 11 is a perspective view illustrating a retaining portion formed at the end of an end plate having a projecting portion for accommodating fms at the side where the tanks are provided.

First, in FIGS. 9 through 11, the heat exchanger 101 is provided with an end plate 115 having a projecting portion 115*a* for housing the fins 106 at a side toward the trailing end in the direction of the lamination of the tube elements 112. At each of the end plates 115 and 115, a retaining portion 110 is formed projecting out in the direction of the length of the end plate 115 at the area of its end toward the tanks with which the seal material 118 comes in contact, i.e., at the center in the widthwise direction. In addition, while the heat exchanger 101 is provided with projecting pieces 121 extending in the direction of the lamination at the tube elements 102 and 112 at their end portions at the opposite side from the tanks, any other structure may be used that ensures that the fins 106 are prevented from falling out, as long as an external circumferential portion around which the band-like seal material 118 can be wound.

In this structure adopted for the heat exchanger 101, the seal material 118 is wound around the heat exchanger 101 as illustrated in FIGS. 9 and 10 by hooking the end of the seal material 118 at one side at the retaining portion 120 formed at the end of one of the end plates 115 toward the tanks, pulling it along the side surface of this end plate 115 to the end opposite from the tanks, then pulling it to the other end plate 115 in the direction of the lamination while maintaining contact with the projecting pieces 121 of the heat exchanger, further pulling it along the side surface of the other end plate 115 to the end of the end plate 115 toward the tanks and finally hooking the end of the seal material 118 at the other side at the retaining portion 120 formed at the end of the other end plate 115 at the end toward the tanks. It is to be noted that while FIG. 9 shows an area where the seal material 118 is not present in the lower area of the heat exchanger 101, this does not present any problem since seal material or the like is provided at the case in this area.

Figure 12:
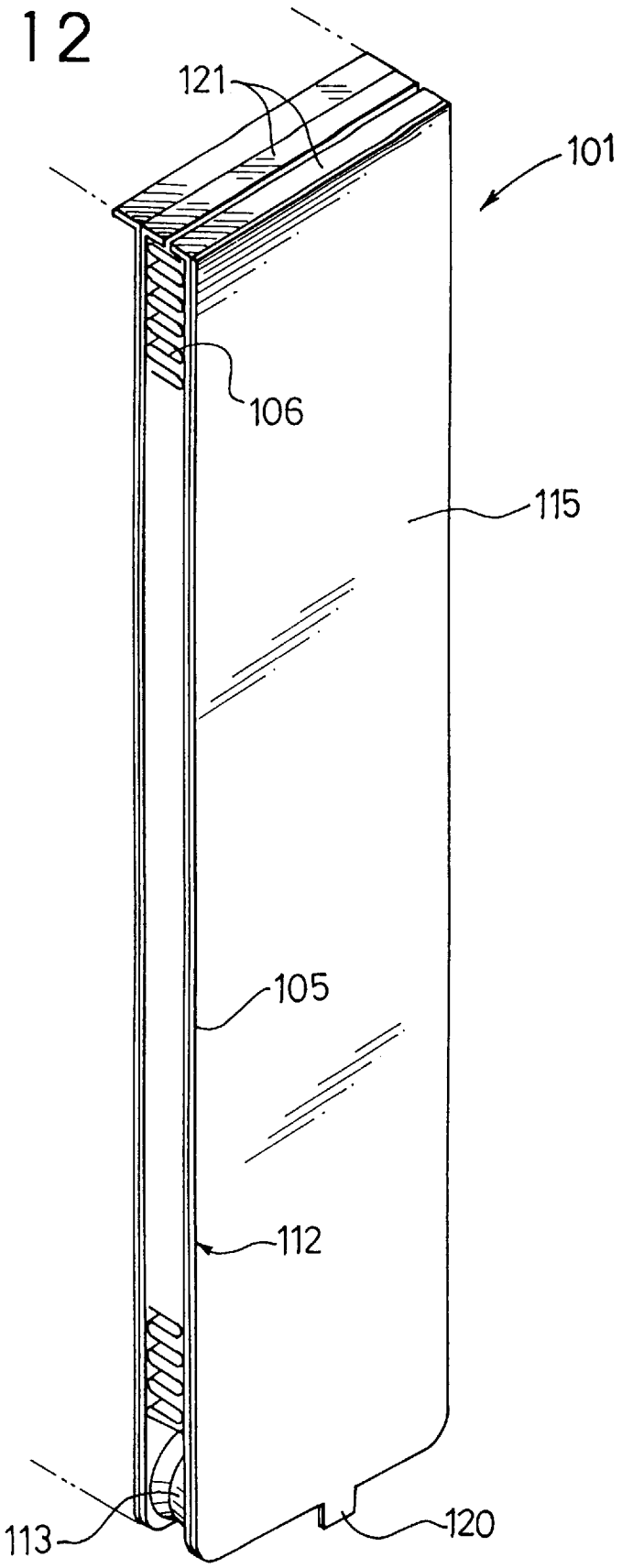
FIG. 12 is a perspective view illustrating a retaining portion constituted by using a flat end plate instead of the end plate shown in FIG. 11.

In addition, the structure of the end plates each having the retaining portion 120 formed at the end in the lengthwise direction toward the tanks is not limited to that provided with the projecting portion 115*a* for accommodating the fins 106 as described above, and flat end plates 115' such as that shown in FIG. 12 may be employed instead. The retaining portion 120 at each end plate 115' may be formed to slightly incline inward so that it can retain the seal material 118 with ease. It is to be noted that since the procedure through which the seal material 118 is wound around at the heat exchanger 101 is almost identical to that employed in the previous embodiment, its explanation is omitted.

Figure 13:
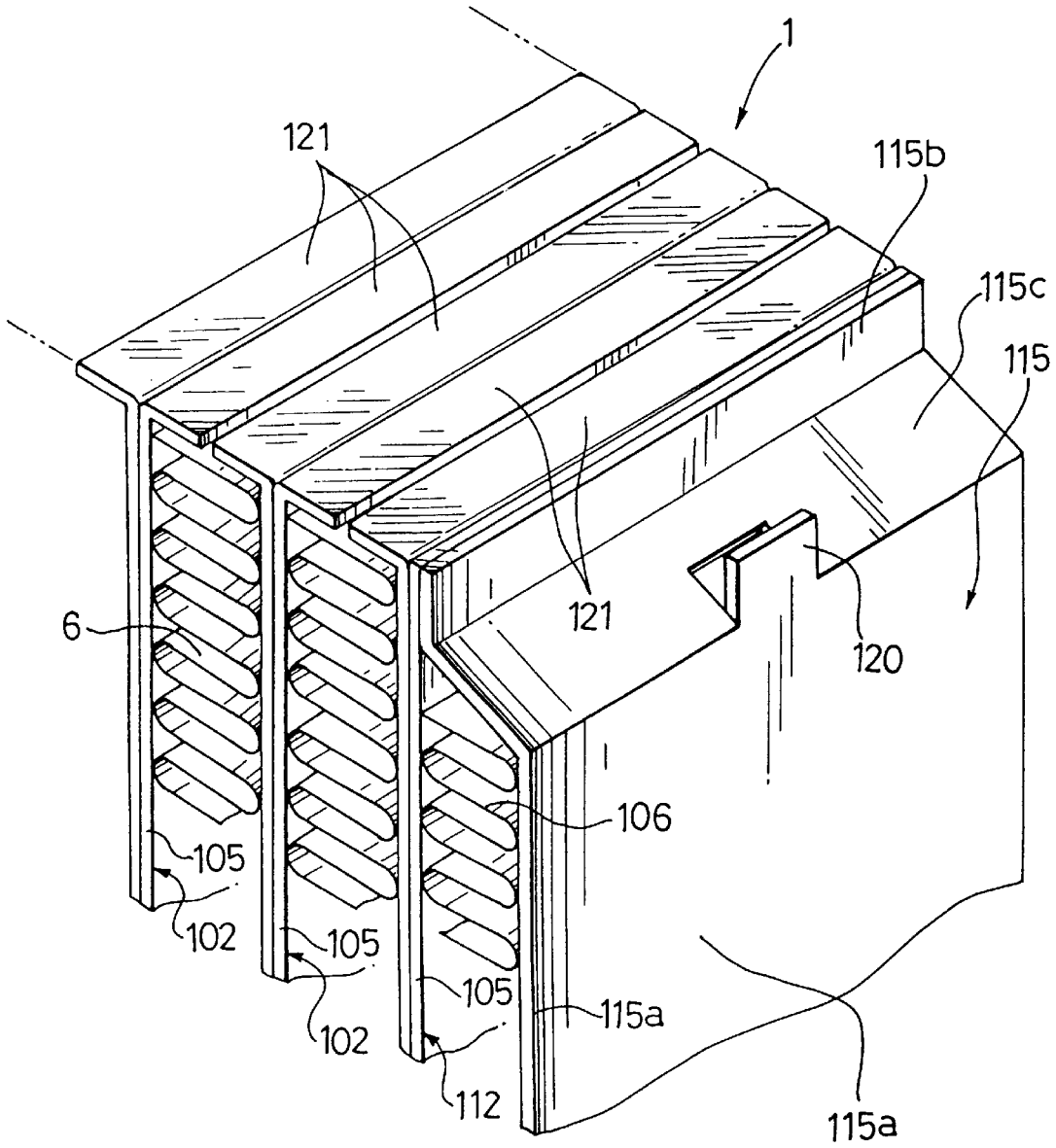
FIG. 13 is a perspective view illustrating a retaining portion formed at a continuous connecting portion between a projecting portion for accommodating fms and a non-projecting portion of an end plate.
Figure 14:
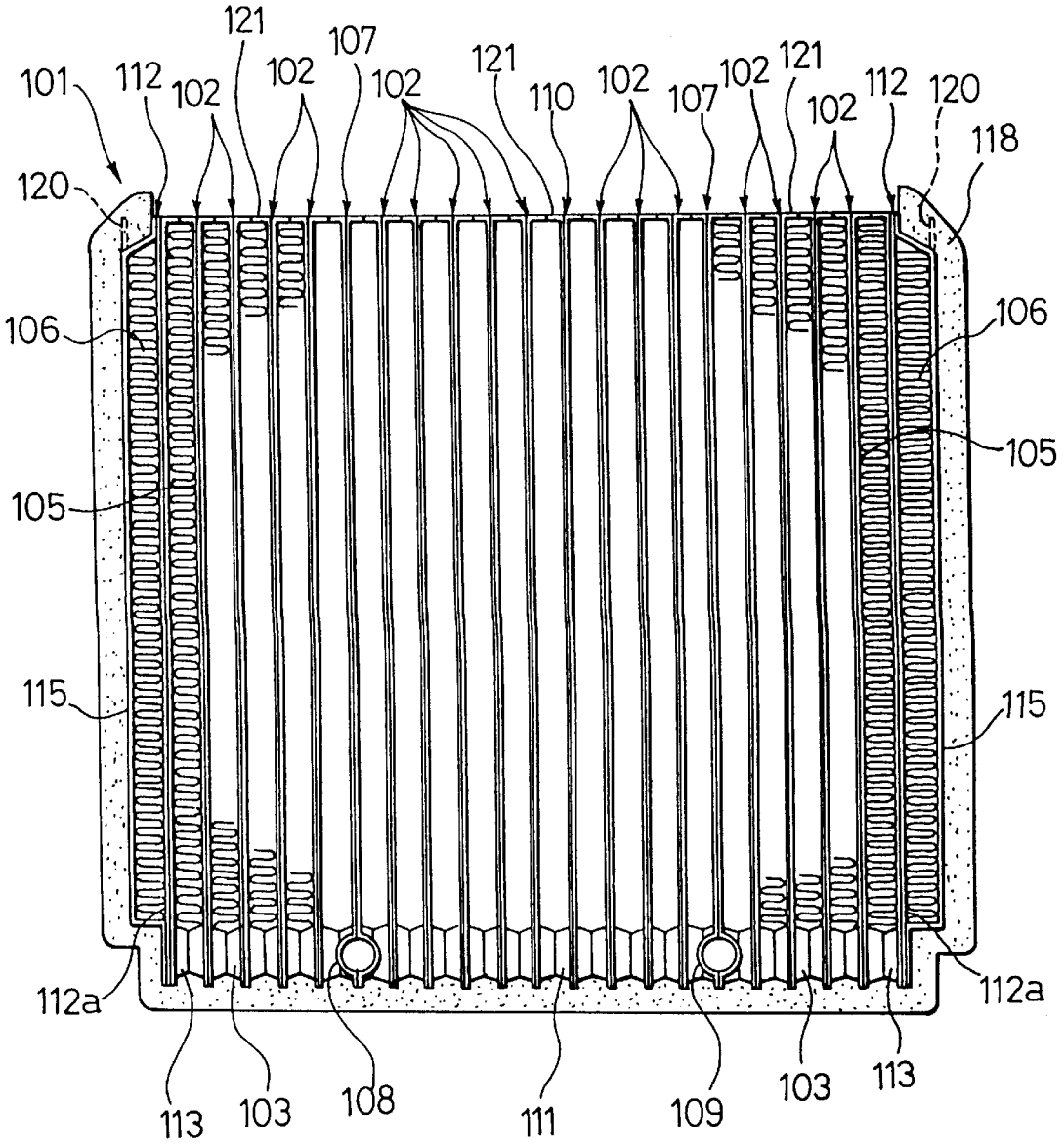
FIG. 14 is a front view of a heat exchanger employing end plates each having the retaining portion above, with the seal material mounted.

The heat exchanger 101 in FIGS. 13 and 14, too, is provided with an end plate 115 having a projecting portion 115*a* for accommodating the fins 106 at the trailing end at each side in the direction of the lamination of the tube elements 112. At each of the end plates 115 and 115, a retaining portion 120 is formed by cutting and raising the portion that comes in contact with the seal material 118 at the side surface of a continuous connecting portion 115*c* between the projecting portion 115*a* and a non-projecting portion 115*b* in such a manner that the boundary between the projecting portion 115*a* and the continuous connecting portion 115*c* forms a bend line. In addition, while projecting pieces 121 extending in the direction of the lamination at the end portions of the tube elements 102 and 112 at the side opposite from the tanks are shown in the figures, any structure that ensures that the fins 106 are prevented from falling out may be adopted for this heat exchanger 101 as long as an external circumferential portion around which the band-like seal material 118 can be wound is constituted, as in the previous embodiment.

In this structure adopted for the heat exchanger 101, the seal material 118 is wound around at the heat exchanger 101 as illustrated in FIG. 14 by first hooking the end of the seal material 118 at one side at the retaining portion 120 constituted by cutting and raising the continuous connecting portion 115*c* of one of the end plates 115, pulling it down to the lower end along the side surface of the end plate 115, then pulling it to the other end plate 115 in the direction of the lamination while maintaining contact with the area between the tanks 103 and 104 of the heat exchanger, further pulling it to the end of the other end plate 115 toward the side opposite from the tanks along the side surface of the other end plate 115 and finally hooking the end of the seal material 118 at the other side at the retaining portion 120 of the other end plate 115. It is to be noted that while FIG. 14 shows an area where no seal material 118 is present in the upper section of the heat exchanger 101, this does not present any problem since seal material or the like is provided at the case in this area.

Figure 15:
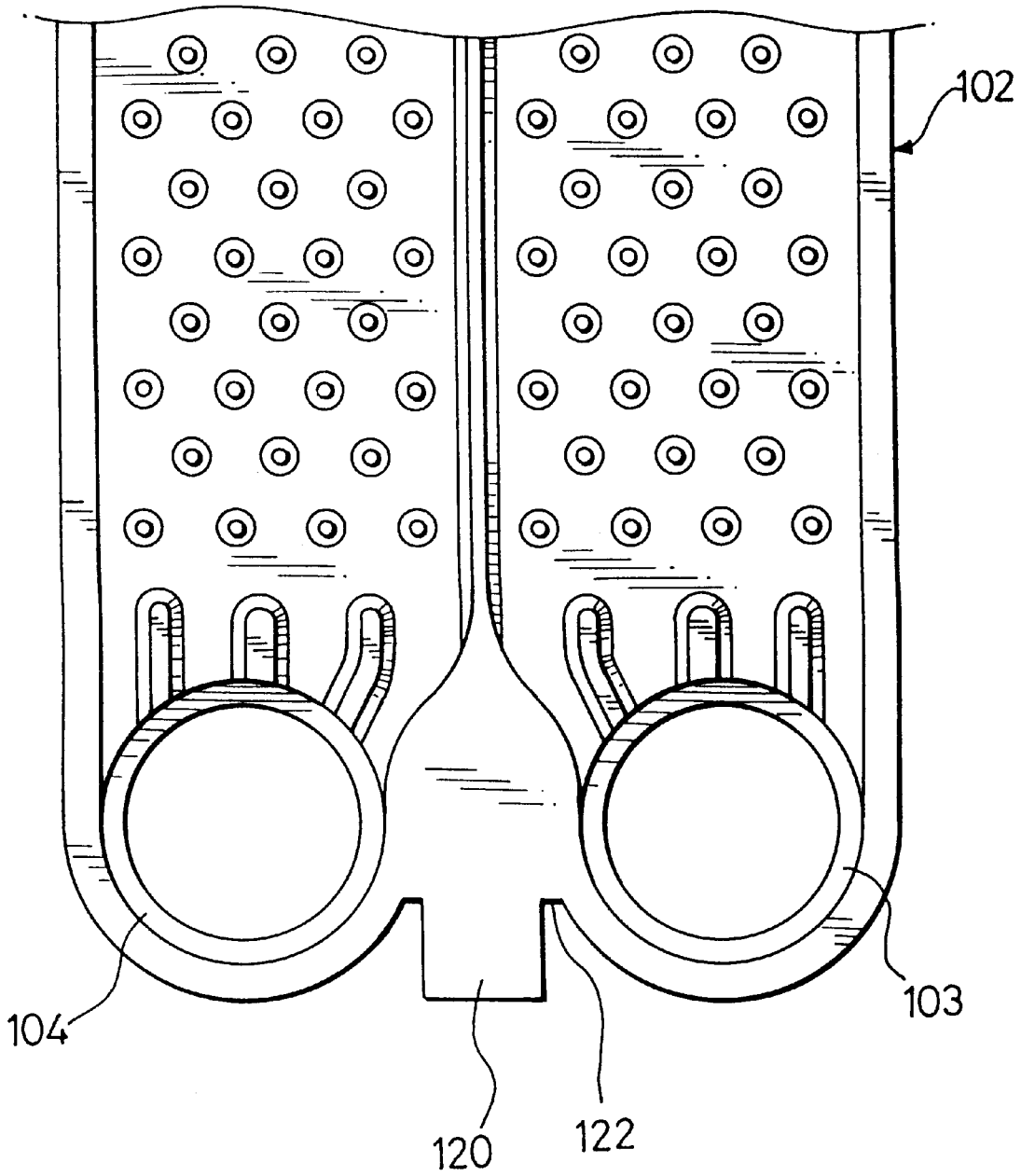
FIG. 15 is a plan view of a retaining portion formed between tanks of a tube element.
Figure 16:
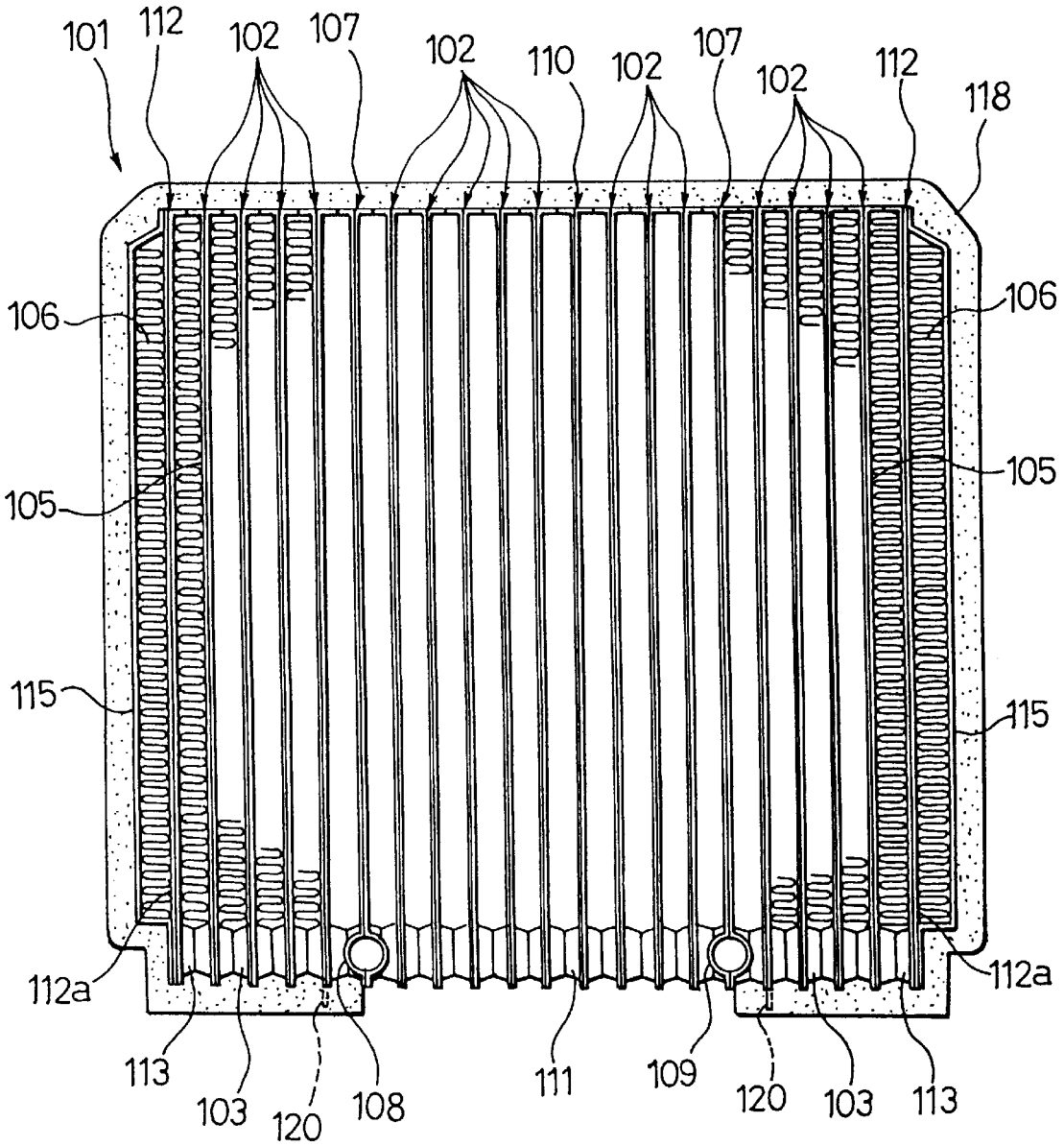
FIG. 16 is a front view of a heat exchanger employing tube elements one of which is shown in FIG. 15, with the seal material mounted.

In addition, in the heat exchanger 101 illustrated in FIGS. 15 and 16, retaining portions 120 are formed projecting out in the direction of the length of the tube elements 102 at groove portions 122 formed between the tanks 103 and 104 of the fifth tube elements 102 and 102 counting from the two end plates 115. Thus, when a communicating passage extending from the groove portions 122 of the tube elements in the direction of the lamination where the seal material 118 can be placed is formed by laminating the tube elements 102, 107, 110 and 112 and further laminating the end plates 115 as necessary, the retaining portions 120 and 120 are formed in the communicating passage.

In this structure adopted for the heat exchanger 101, the seal material 118 is wound around at the heat exchanger 101 as shown in FIG. 16 by first hooking the end of the seal material 118 at one side at the retaining portion 120 formed between the tanks 103 and 104 of the fifth tube element 102 counting from the right side end plate 115 in the figure, pulling to the end at that side in the direction of the lamination while maintaining contact with the area between the tanks 103 and 104, then pulling it up to the end at the side opposite from the tanks along the side surface of the end plate 115 at the right side in the figure, further pulling it back to the end at the opposite side in the direction of the lamination while maintaining contact with the projecting piece 121, then pulling it to the end toward the tanks along the side surface of the end plate 115 at the left side in the figure, pulling it to the fifth tube element 102 counting from the left-side end plate 115 in the figure in the direction of the lamination while maintaining contact with the area between the tanks 103 and 104 and finally hooking it at the retaining portion 102 formed between the tanks 103 and 104 of the second tube element 102. It is to be noted that while FIG. 16 shows an area where the seal material 118 is not present in the lower part of the heat exchanger 101, this does not present any problem since seal material or the like is provided at the case in this area.

It is to be noted that the retaining portions 120 may not necessarily have to be formed at the fifth tube elements counting from the end plates 115, and they may be formed at the tube elements 112 adjacent to the end plates 115, at the tube element 110 at the center in the direction of the lamination or at the tube elements 107 where the inflow/outflow portions 108 and 109 are formed. Furthermore, the retaining portions 120 may be formed at positions that are asymmetrical when viewed from the direction of the airflow, e.g, at the eighth tube element from the end plate 115 at the right side and at the third tube element from the end plate 115 at the left side in FIG. 16. Moreover, by forming the retaining portions 120 at adjacent tube elements, the area where the seal material 118 is not present is almost completely eliminated, thereby precluding the necessity for forming a seal material at the case side.

Figure 17:
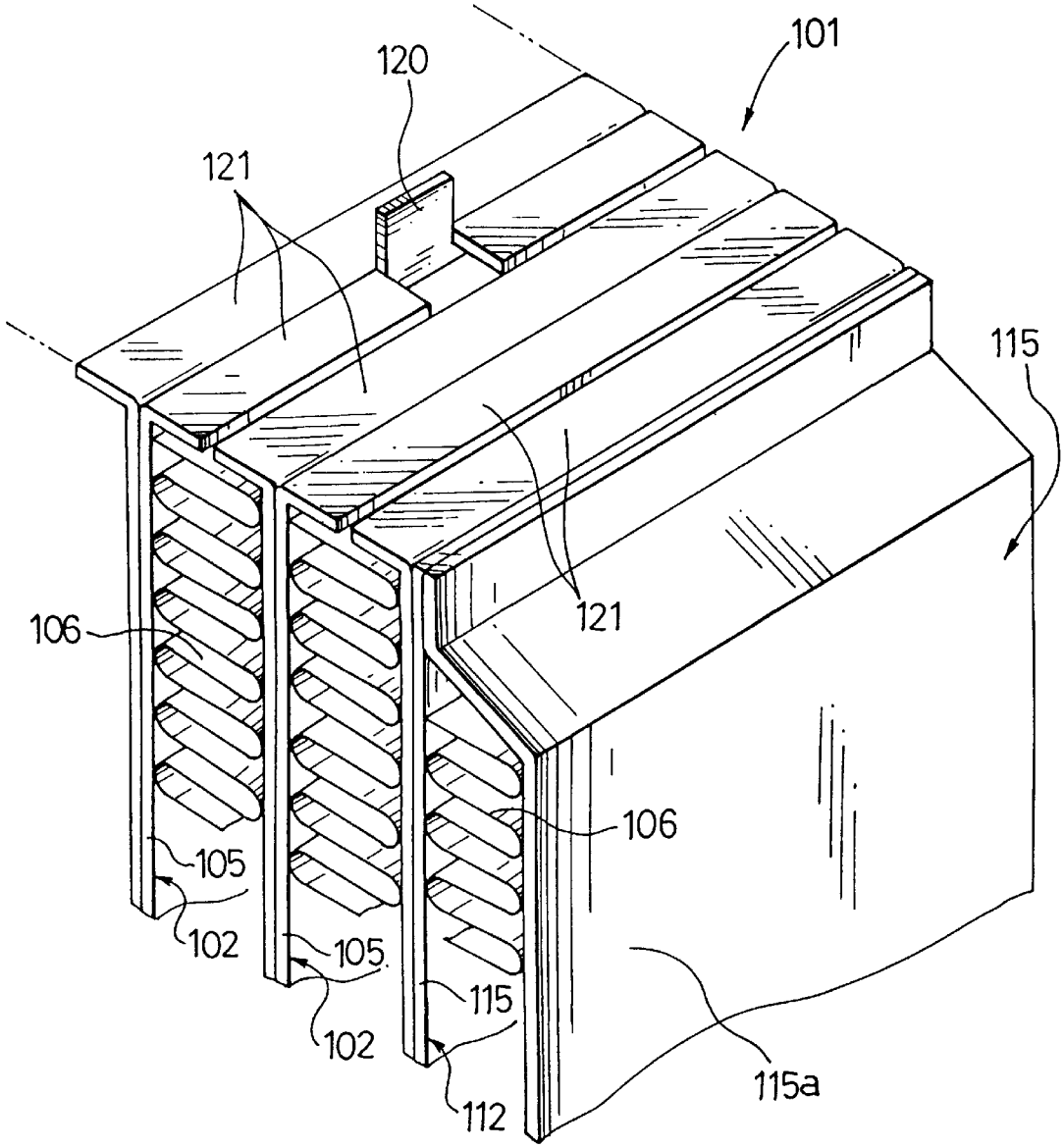
FIG. 17 is a perspective view illustrating a retaining portion formed at a projecting piece of a tube element.
Figure 18:
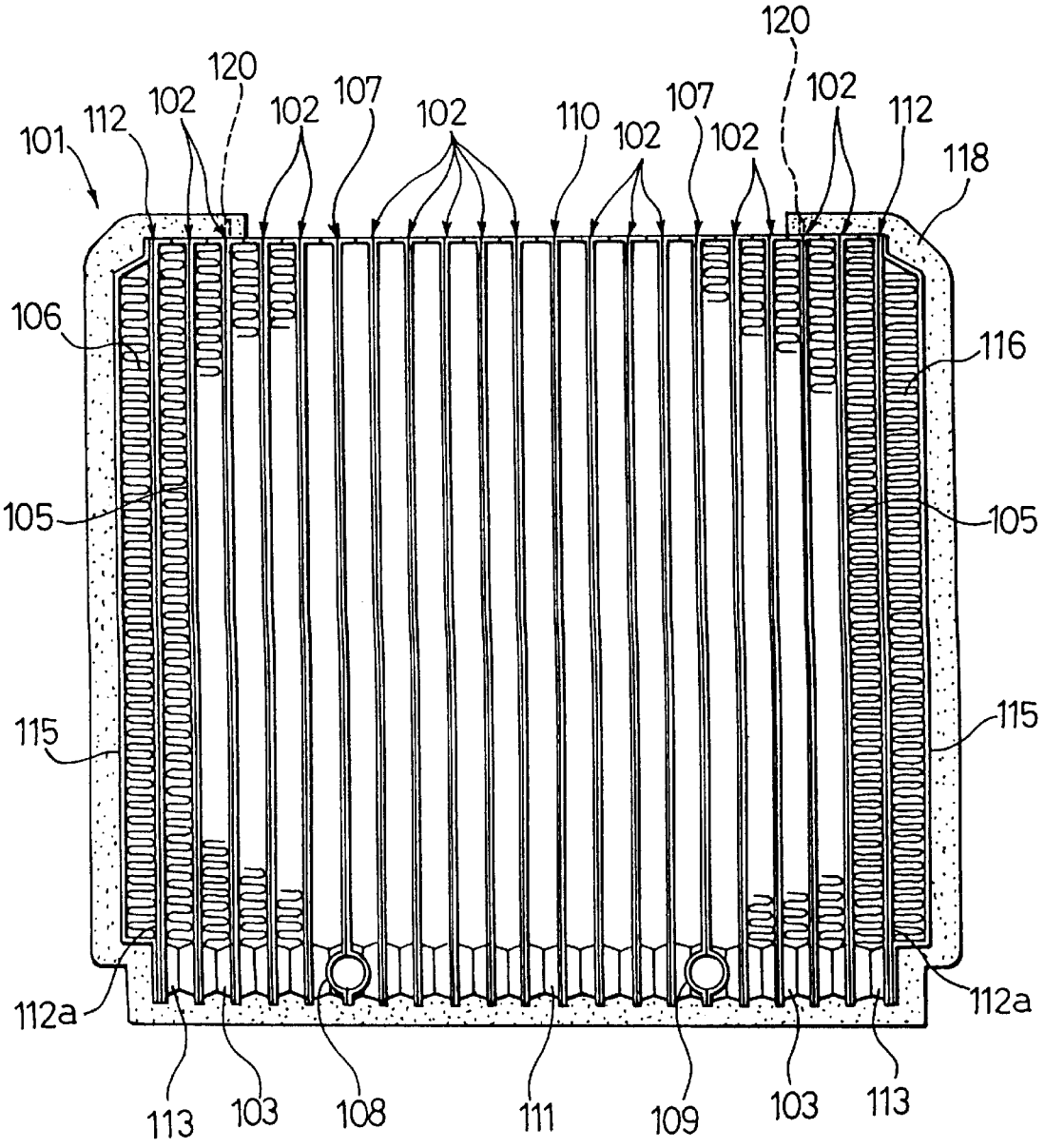
FIG. 18 is a front view of a heat exchanger employing tube elements one of which is shown in FIG. 17, with the seal material mounted.

In FIGS. 17 and 18, the heat exchanger 101 is provided with projecting pieces 121 and 121 at each first tube element 102 extending at the two sides in the direction of the lamination at the end toward the tanks in order to prevent the fins 6 from falling out. It is to be noted that although not shown, the tube elements 107, 110 and 112, too, are each provided with projecting pieces at the upper end extending inward in the direction of the lamination. A raised portion 120 is formed at the third tube element 102 counting from the end plate 115 at the right side and at the third tube element 102 counting from the end plate 115 at the left side in FIG. 18, constituted by cutting and raising the approximate center of the projecting piece 121 in the direction of the lamination. While the heat exchanger 101 illustrated in the figures is provided with end plates 115 each having a projecting portion 115*a* for housing the fins 106 at the trailing end of the fourth tube element 112 in the direction of the lamination, the structure of the end plates 115 is not limited to this, and end plates 115 such as one of which is shown in FIG. 12, for instance, may be employed since the only structural requirement is that an external circumferential portion around which the band-like seal material 118 can be wound is constituted.

Figure 19:
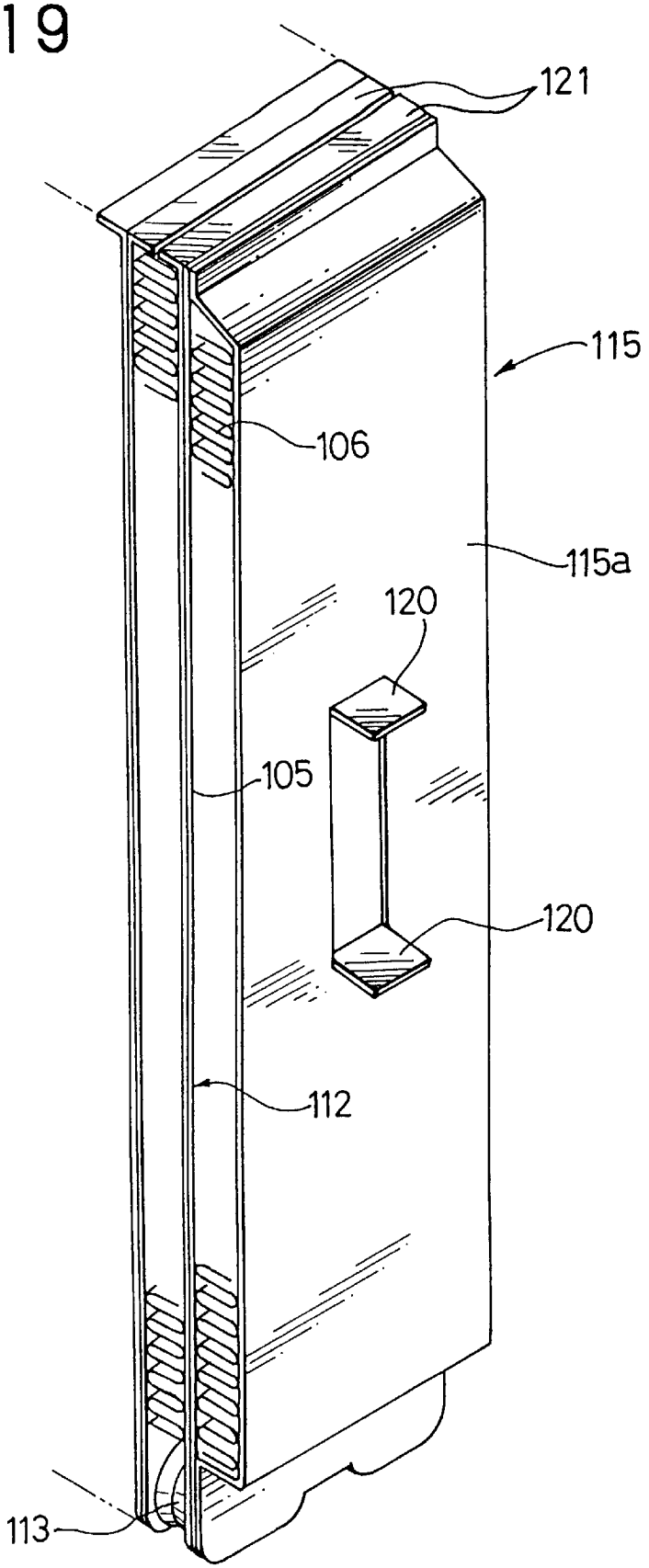
FIG. 19 is a perspective view illustrating a pair of retaining portions formed at a side surface of one of the end plates.

In this structure adopted for the heat exchanger 101, the seal material 118 is wound around the heat exchanger as illustrated in FIG. 19 by first hooking the end of the seal material 118 at one side at the retaining portion 120 formed at the projecting piece 121 formed at the third tube element 102 counting from the right side end plate 115 in the figure, pulling it to the end plate 115 at the left side in the figure in the direction of the lamination while maintaining contact with the projecting pieces 121, then pulling it to the end toward the tanks along the side surface of the end plate 115 at the left side in the figure, further pulling it back to the end plate 115 at the left side in the figure along the area between the tanks 103 and 104, pulling it to the end opposite from the tanks along the side surface of the end plate 115 at the left side in the figure, then pulling it to the third tube element 102 counting from the end plate 115 at the left side in the figure in the direction of the lamination while maintaining contact with the projecting pieces 121 and finally hooking it at the retaining portion 120 formed at the projecting piece 121 of this tube element 102. It is to be noted that while FIG. 18 shows an area where the seal material 118 is not present in the upper section of the heat exchanger 101, this does not present any problems since seal material or the like is provided at the case in this area.

Moreover, the retaining portions 120 do not necessarily have to be formed at the third tube elements counting from the end plates 115, and they may be formed at the tube elements 112 that are adjacent to the end plates 115, at the tube element 110 at the center in the direction of the lamination or at the tube elements 107 where the inflow/outflow portions 108 and 109 are formed. The retaining portions 120 may even be formed at positions that are asymmetrical when viewed from the direction of the airflow, e.g., at the third tube element counting from the end plate 115 at the right side and at the fifth tube element counting from the end plate 115 at the left side in FIG. 18. Furthermore, by forming the retaining portions 120 at adjacent tube elements, the area where the seal material 118 is not present s almost completely eliminated, thereby precluding the necessity for forming a seal material at the case side.

Figure 20:
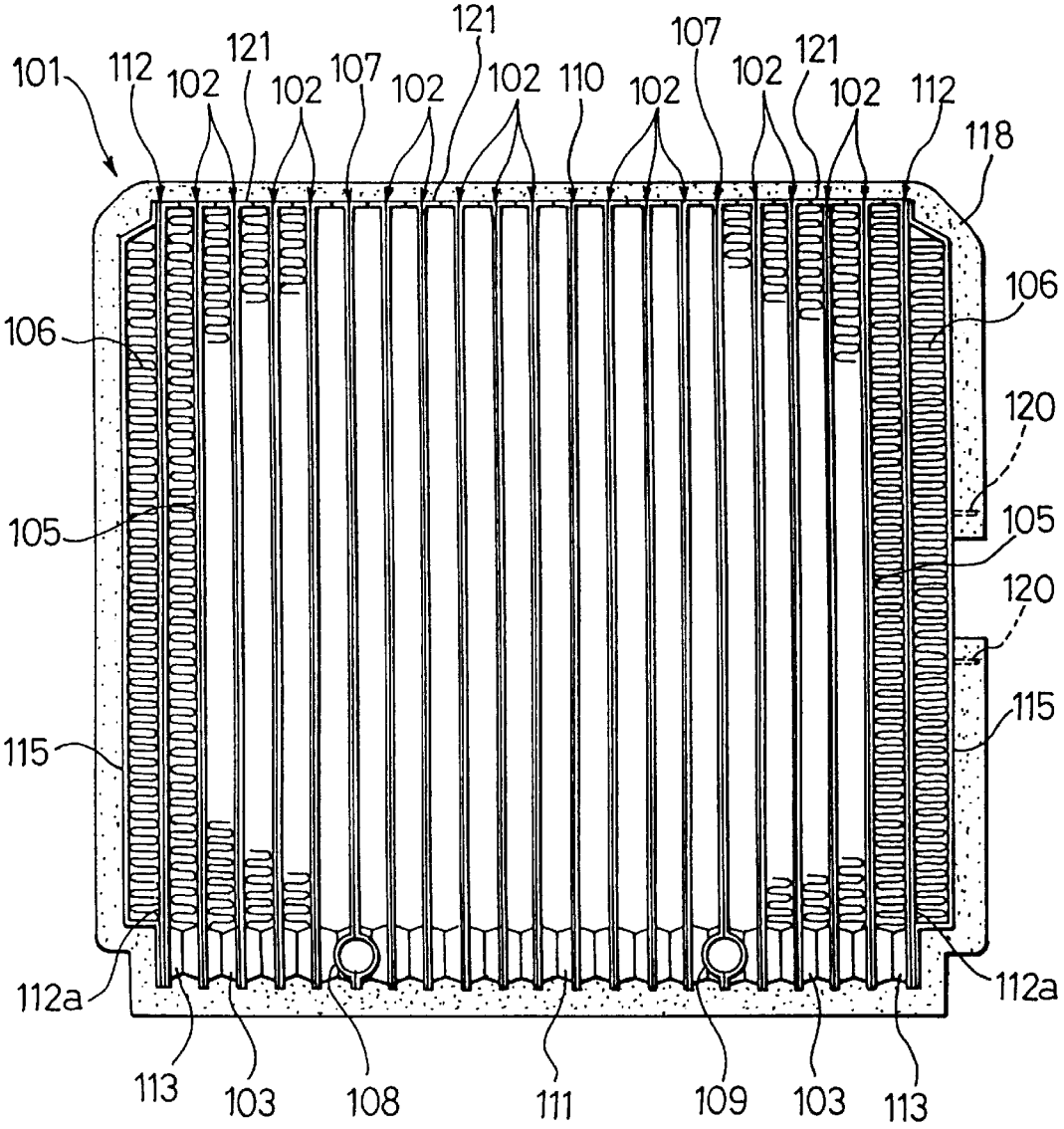
FIG. 20 is a front view of a heat exchanger employing the end plate shown in FIG. 19, with the seal material mounted.

In FIGS. 19 and 20, the heat exchanger 101 is provided with an end plate 115 having a projecting portion 115*a* for housing the fins 106 at least at one side in the direction of the lamination of the tube elements 112. This end plate 115 is provided with retaining portions 120 and 120 formed by cutting and raising a portion of the side surface that comes in contact with the seal material 118 upward and downward in the lengthwise direction. While the heat exchanger 101 is illustrated with the projecting pieces 121 formed at the upper end portions of the tube elements 102 and 112 extending in the direction of the lamination, any other structure that ensures that the fins 106 are prevented from falling out may be adopted instead as long as an external circumferential portion around which the band-like seal material 118 can be wound is constituted.

In this structure adopted for the heat exchanger 101, the seal material 118 is wound around at the heat exchanger 101 as illustrated in FIG. 20 by first hooking the end portion of the seal material 118 at one side at the upper retaining portion 120 of the end plate 115, pulling it to the end at the opposite side from the tanks along the side surface of the end plate 115, then pulling it to the end plate 115 at the left side in the figure while maintaining contact with the projecting pieces 121, further pulling it to the end toward the tanks along the side surface of this end plate 115, then pulling it back to the end plate 115 at the right side in the figure in the direction of the lamination while maintaining contact with the area between the tanks 103 and 104 of the tube elements 102, pulling it to the lower retaining portion 120 of the end plate 115 along the side surface of the end plate 115 and finally hooking the other end of the seal material 118 at the retaining portion 120. It is to be noted that while FIG. 20 shows an area where the seal material 118 is not present at the side of the heat exchanger 101, this does not present a problem since seal material or the like at the case is present in this area.

In addition, if the distance between the retaining portions 120 and 120 formed by cutting and raising the end plate 115 is reduced, the range over which the seal material 118 is not present becomes extremely small, which will eliminate the necessity for forming the seal material at the case side.

Thus, by forming the retaining portions 120 as illustrated in FIGS. 9 through 20, the necessity for a means for securing such as an adhesive for mounting the seal material 118 is eliminated. At the same time, the mounting of the seal material 118 is facilitated since it can be mounted simply by retaining the seal material 118 at the retaining portions 120.

Furthermore, the sorting operation for sorting the parts of the laminated heat exchanger 101 into constituent materials for disposal of the laminated heat exchanger 101 can be simplified.

In addition, since a special part for mounting the seal material 118 at the external circumferential portion of the heat exchanger 101 is not required, the number of required parts does not have to increase.

It is to be noted that while five embodiments have been given as examples of the retaining portions 120, a plurality of embodiments of the retaining portions 120 may be adopted in combination. For instance, one of the retaining portions 120 may be formed at the lower end of the end plate 115 in the lengthwise direction as illustrated in FIG. 20 with the other retaining portion 120 formed between the tanks 103 and 104 of the tube element 102, as shown in FIG. 15, or one of the retaining portions 120 may be formed at the upper end of an end plate 115 in the lengthwise direction with the other retaining portion 120 formed at the projecting piece 121 of the tube element 102, as shown in FIG. 17. Thus, there are an unlimited number of possible configurations.

As has been explained, in the heat exchanger according to the present invention, since the seal material is mounted wound around the external circumferential portion of the heat exchanger by hooking the end of the band-like seal material at one side at one retaining portion that is formed at a specific position at the external circumferential portion of the heat exchanger, pulling the seal material along the external circumferential portion of the heat exchanger and hooking the other end of the seal material at another retaining portion formed at a specific position at the external circumferential portion, the removal of the seal material from the heat exchanger for dismantling the heat exchanger is facilitated, thereby supporting the requirements for recycling the materials of the heat exchanger.

What is claimed is:

1. A heat exchanger comprising:

a heat exchanger main body having a plurality of elongated tube elements through which a coolant flows and a plurality of fins laminated between said tube elements with an external circumferential portion of said heat exchanger main body constituted of two opposing first side surfaces of said heat exchanger main body in the direction of lamination and two opposing second side surfaces of said heat exchanger main body in the direction of the length of said tube elements;

a band-like seal material that fills a gap between said external circumferential portion of said heat exchanger main body and a case in which said heat exchanger main body is housed; and a seal material mounting guide formed at at least one of said two opposing second side surfaces of said heat exchanger main body to hold said seal material by clamping said seal material therein, so as to mount said seal material at said external circumferential portion of said heat exchanger main body.

2. A heat exchanger according to claim 1, wherein:

each of said tube elements is provided, at one end thereof in said length direction, with projecting pieces extending in said direction of lamination, so as to constitute one of said second opposing side surfaces of said external circumferential portion of said heat exchanger main body; and said seal material mounting guide comprises indented portions said projecting pieces disposed contiguously in said direction of lamination.

3. A heat exchanger according to claim 1, wherein:

each of said tube elements is provided, at one end thereof in said length direction, with projecting pieces extending in said direction of lamination, so as to constitute one of said second opposing side surfaces of said external circumferential portion of said heat exchanger main body; and said seal material mounting guide comprises erect pieces extending outwardly from said projecting pieces in said length direction.

4. A heat exchanger according to claim 1, further comprising:

an end plate having a projecting portion for accommodating one of said fins and constituting a portion of said external circumferential portion, wherein:

said seal material mounting guide comprises an indented portion formed at a corner of said projecting portion located at an end in said length direction.

5. A heat exchanger according to claim 1, wherein:

each of said tube elements is provided with a pair of tanks formed at a lower end thereof in said length direction and a U-shaped heat exchanging medium passage communicating between said tanks, said pairs of tanks of said tube element being provided continuously in said direction of lamination to constitute a portion of said external circumferential portion; and said seal material mounting guide comprises indented portions formed by notches disposed between said pair pairs of tanks, respectively, in said tube elements.

6. A heat exchanger according to claim 1, wherein:

said seal material mounting guide is formed at both of said two opposing second side surfaces of said heat exchanger main body.

7. A heat exchanger according to claim 1, wherein:

each of said tube elements is formed of a pair of plates and comprises a pair of tanks connected by a U-shaped passage.

8. A heat exchanger comprising:

a heat exchanger main body having a plurality of elongated tube elements through which a coolant flows and a plurality of tins laminated between said tube elements with an external circumferential portion of said heat exchanger main body constituted of two opposing first side surfaces of said heat exchanger main body in the direction of lamination and two opposing second side surfaces of said heat exchanger main body in the direction of the length of said tube elements;

a band-like seal material that fills a gap between said external circumferential portion of said heat exchanger main body and a case in which said heat exchanger main body is housed; and a plurality of retaining portions at which said seal material can be hooked at said external circumferential portion of said heat exchanger main body, to mount said seal material at said external circumferential portion of said heat exchanger main body.

9. A heat exchanger according to claim 8, further comprising:

end plates provided at either side of said heat exchanger main body in said direction of lamination to constitute a portion of said external circumferential portion, wherein:

said retaining portions are formed by portions of said end plates projecting out in said length direction at one end in said length direction.

10. A heat exchanger according to claim 8, further comprising:

end plates, each provided at one end in said direction of lamination of said tube elements and having a protecting portion for accommodating said fins, which constitute a portion of said external circumferential portion, wherein:

said retaining portions are formed by cut and raised continuous connecting portions each located between said projecting portion and a non-projecting portion of each of said end plates in said length direction.

11. A heat exchanger according to claim 8, wherein:

each of said tube elements is provided with a pair of tanks formed at an end thereof in said length direction and a U-shaped heat exchanging medium passage communicating between said tanks, said pairs of tanks of said tube elements being provided continuously to constitute a portion of said external circumferential portion; and said retaining portions are each formed by projections extending in said length direction of said tube elements at an area between said tanks.

12. A heat exchanger according to claim 8, wherein:

each of said tube elements is provided, at one end thereof in said length-direction with projecting pieces extending in said direction of lamination, so as to constitute one of said second opposing side surfaces of said external circumferential portion are of said heat exchanger main body; and each of said retaining portions comprising a put and raised portion of one of said projecting pieces and extends almost perpendicular to said direction of lamination.

13. A heat exchanger according to claim 8, further comprising:

end plates, each provided at one end in said direction of lamination of said tube elements and constituting a portion of said external circumferential portion, wherein:

each of said retaining portions comprises a cut and raised portion of a side surface of one of said end plates and extends in said direction of lamination.

14. A heat exchanger according to claim 8, wherein:

each of said tube elements is formed of a pair of plates and comprises a pair of tanks connected by a U-shaped passage.

* * * * *